US009512680B2

(12) United States Patent
Campbell et al.

(10) Patent No.: US 9,512,680 B2
(45) Date of Patent: Dec. 6, 2016

(54) CORING BIT TO WHIPSTOCK SYSTEMS AND METHODS

(71) Applicant: Smith International, Inc., Houston, TX (US)

(72) Inventors: John Campbell, Houston, TX (US); Shantanu N. Swadi, Cypress, TX (US); Charles Dewey, Houston, TX (US); Robert Utter, Sugar Land, TX (US); Praful C. Desai, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 397 days.

(21) Appl. No.: 14/104,639

(22) Filed: Dec. 12, 2013

(65) Prior Publication Data

US 2014/0166367 A1 Jun. 19, 2014

Related U.S. Application Data

(60) Provisional application No. 61/736,982, filed on Dec. 13, 2012.

(51) Int. Cl.

| | |
|---|---|
| ***E21B 10/02*** | (2006.01) |
| ***E21B 25/00*** | (2006.01) |
| ***E21B 33/12*** | (2006.01) |
| ***E21B 49/06*** | (2006.01) |
| ***E21B 33/128*** | (2006.01) |

(52) U.S. Cl.

CPC ..... *E21B 10/02* (2013.01); *E21B 25/00* (2013.01); *E21B 33/1285* (2013.01); *E21B 49/06* (2013.01)

(58) Field of Classification Search

CPC ..... E21B 25/00; E21B 10/02; E21B 49/06; E21B 7/061

See application file for complete search history.

(56) References Cited

U.S. PATENT DOCUMENTS

| | | | | |
|---|---|---|---|---|
| 2,324,682 A | | 7/1943 | Long | |
| 2,331,293 A | | 10/1943 | Ballard | |
| 2,364,088 A | * | 12/1944 | Miller | E21B 25/08 175/233 |
| 2,494,932 A | | 1/1950 | Denning et al. | |

(Continued)

OTHER PUBLICATIONS

International Search Report and Written Opinion issued in PCT/US2013/074904 on Mar. 26, 2014, 15 pages.

(Continued)

*Primary Examiner* — Jennifer H Gay

(57) ABSTRACT

A coring system and method enable a single-trip operation for setting a deflector assembly, deploying a coring assembly and obtaining a core sample from a borehole drilled in a wellbore. The coring assembly has a barrel with a bore for collecting the core sample and has a coring bit coupled to an end portion of the barrel. The deflector system is arranged to deflect the coring bit into a side wall of the wellbore to drill the borehole therein. The deflector system includes a deflector and a collar. The collar, coupled to the deflector, restricts upward movement of the coring assembly relative to the deflector assembly. The collar may also be used as a retrieval device to engage the coring assembly and permit removal of the coring assembly and the deflector assembly as well as the core sample after the core sample has been obtained.

20 Claims, 15 Drawing Sheets

(56) References Cited

U.S. PATENT DOCUMENTS

| | | | | | |
|---|---|---|---|---|---|
| 2,553,874 | A * | 5/1951 | Spaulding | E21B 7/061 | 175/325.2 |
| 2,586,662 | A * | 2/1952 | Jackson | E21B 7/061 | 175/320 |
| 4,396,074 | A | 8/1983 | Jageler et al. | | |
| 4,449,593 | A | 5/1984 | Jageler et al. | | |
| 4,466,495 | A | 8/1984 | Jageler | | |
| 4,609,056 | A | 9/1986 | Colle, Jr. et al. | | |
| 4,765,404 | A | 8/1988 | Bailey et al. | | |
| 4,930,587 | A * | 6/1990 | Young | E21B 25/14 | 175/251 |
| 5,163,522 | A | 11/1992 | Eaton et al. | | |
| 5,211,715 | A * | 5/1993 | Braden | E21B 7/061 | 166/117.5 |
| 5,222,554 | A | 6/1993 | Blount et al. | | |
| 5,310,013 | A * | 5/1994 | Kishino | E21B 49/06 | 175/244 |
| 5,322,135 | A | 6/1994 | Travis | | |
| 5,443,129 | A * | 8/1995 | Bailey | E21B 7/061 | 166/117.6 |
| 5,826,651 | A | 10/1998 | Lee et al. | | |
| 6,050,334 | A | 4/2000 | McGarian et al. | | |
| 7,021,404 | B2 * | 4/2006 | Fanuel | E21B 25/00 | 166/298 |
| 7,117,958 | B2 | 10/2006 | Fanuel et al. | | |
| 7,377,328 | B2 | 5/2008 | Dewey et al. | | |
| 7,530,407 | B2 | 5/2009 | Tchakarov et al. | | |
| 2007/0261886 | A1 * | 11/2007 | Wilson | E21B 10/02 | 175/58 |
| 2010/0155083 | A1 * | 6/2010 | Lynde | E21B 23/01 | 166/382 |
| 2011/0247881 | A1 | 10/2011 | Orban et al. | | |
| 2013/0168151 | A1 * | 7/2013 | Grigor | E21B 23/04 | 175/61 |
| 2014/0166367 | A1 * | 6/2014 | Campbell | E21B 25/00 | 175/58 |
| 2015/0021097 | A1 * | 1/2015 | Wesemeier | E21B 25/00 | 175/59 |

OTHER PUBLICATIONS

Office Action issued in related Norwegian application No. 20150763 on Jun. 9, 2016, 6 pages.

* cited by examiner

CORING BIT TO WHIPSTOCK SYSTEMS AND METHODS

CROSS-REFERENCE TO RELATED APPLICATIONS

This application claims the benefit of related U.S. Provisional Application Ser. No. 61/736,982 filed Dec. 13, 2012, entitled "Single-Trip Lateral Coring Systems and Methods," to Utter et al., the disclosure of which is incorporated by reference herein in its entirety. This application is also related to U.S. patent application Ser. No. 14/104,566 filed Dec. 12, 2013, entitled "Single-Trip Lateral Coring Systems and Methods," to Utter et al., the disclosure of which is incorporated by reference herein in its entirety.

BACKGROUND

In order to determine the properties of a particular formation, a core sample may be extracted. For instance, a vertical or horizontal hole may be created in a formation. A column of rock or other materials found in the formation may be extracted as the hole is made, and then removed from the hole, after which a detailed study may be performed. The detailed study and analysis may yield information and identify the lithology of the formation. Other characteristics such as porosity and permeability of the formation, the potential storage capacity and/or production potential for hydrocarbon-based fluids (e.g., oil and natural gas), and the like may also be determined from the core sample.

Example coring systems may attempt to extract the core sample in a state that, to the extent possible, closely resembles the natural state in which the rock and other materials are found in the formation. For instance, a coring bit may be coupled to a drill string and extended into a hole, such as a wellbore, borehole or other subterranean tunnel. The coring bit may include a central opening or aperture and, as the coring bit rotates and drills deeper into the formation, materials from the hole can enter through the central opening and form a column of rock in the drill string. When the column is sufficiently long, the column of rock may be retrieved and brought to the surface.

The column of rock forming the core sample may form directly within the drill string, and then be returned to the surface by lifting the coring bit towards the surface. In other systems, a core barrel may be lowered through the central opening in the drill string. A column of rock can form in the core barrel, and the core barrel can be retrieved. Another core barrel may then be lowered through the drill string and used to obtain another core sample from the drilled section of the formation.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

Implementations of systems and/or methods to extract a core sample of a formation from a lateral section drilled into the sidewall of a wellbore or from another drilled section of the formation are disclosed. In one implementation, a single-trip coring system is disclosed to extract a core sample in a single downhole trip. The single-trip coring system includes a coring assembly, a deflector assembly and a coupler to releasably couple the coring assembly to the deflector assembly. The coring assembly has a barrel with a bore, e.g., a collection chamber or cavity, at least partially therethrough for capturing or collecting a core sample and has a coring bit coupled to an end portion of the barrel. The deflector system is arranged to deflect the coring bit of the coring assembly into a side wall of a wellbore to drill a lateral section or borehole therein. The deflector system includes a deflector and a collar, which is coupled to the deflector. The collar restricts upward movement of the coring assembly relative to the deflector assembly. The collar may also be used as a retrieval device to engage the coring assembly and permit removal of both the coring assembly and the deflector assembly after a core sample has been obtained. The single-trip coring system permits: the coupled coring assembly and deflector assembly to be tripped into a wellbore as a single unit, the coring assembly to be decoupled from the deflector assembly to allow the coring assembly to drill the lateral section or borehole into a sidewall of a wellbore and extract a core sample, and the coring assembly, deflector assembly and core sample to be tripped from the wellbore, all in a single trip.

In another implementation, a method is disclosed to extract a core sample from a lateral section drilled into a side wall of a wellbore within a single trip. A coring system is lowered into a wellbore. The coring system includes a coring assembly releasably coupled to a deflector assembly. The defector assembly is anchored at a desired angular orientation and axial position with the wellbore. A coupler is released between the coring assembly and the deflector assembly. A lateral section is drilled into a sidewall of the wellbore using the coring assembly guided by the deflector assembly. A core sample is obtained from the lateral section drilled into the side wall of the wellbore. The coring assembly is retracted from the lateral section and engages with the deflector assembly. The deflector assembly is unanchored from its annular orientation and axial position with the wellbore. Finally, the defector assembly, the coring assembly and the core sample are removed from the wellbore with the method being accomplished in a single downhole trip.

In another implementation, a coring system having a fluid bypass valve is disclosed. The coring system includes an outer barrel and an inner barrel with the inner barrel disposed within the outer barrel. The inner and outer barrels define an annular region or channel therebetween for conveying fluid. A port that leads to a fluid outlet is disposed in the outer barrel and is in fluid communication with the channel. A pressure sleeve, responsive to pressure in the channel, is disposed at least partially within the channel defined between the outer barrel and the inner barrel. A first coupler couples the pressure sleeve in a first position. The first coupler is arranged to be uncoupled, e.g., by shearing a sacrificial element of the first coupler, to allow the pressure sleeve to selectively move between the first position blocking fluid flow through the channel while permitting fluid flow through the port and a second position permitting fluid flow through the channel around the pressure sleeve. The coring system also includes a shear sleeve disposed around the outer barrel. A second coupler couples the shear sleeve in a first position. The second coupler is arranged to be uncoupled, e.g., by shearing a sacrificial element of the second coupler, to allow the shear sleeve to selectively move between the first position permitting fluid flow through the port to the fluid outlet and a second position blocking fluid flow from the port to the fluid outlet.

Other features and aspects of the present disclosure will become apparent to those persons skilled in the art through consideration of the ensuing description, the accompanying drawings, and the appended claims. Accordingly, all such features and aspects are intended to be included within the scope of this disclosure.

BRIEF DESCRIPTION OF DRAWINGS

In order to describe various features and concepts of the present disclosure, a more particular description of certain subject matter will be rendered by reference to specific implementations which are illustrated in the appended drawings. Understanding that these drawings depict only some example implementations and are not to be considered to be limiting in scope, nor drawn to scale for all implementations, various implementations will be described and explained with additional specificity and detail through the use of the accompanying drawings in which.

DETAILED DESCRIPTION

Figure 1:
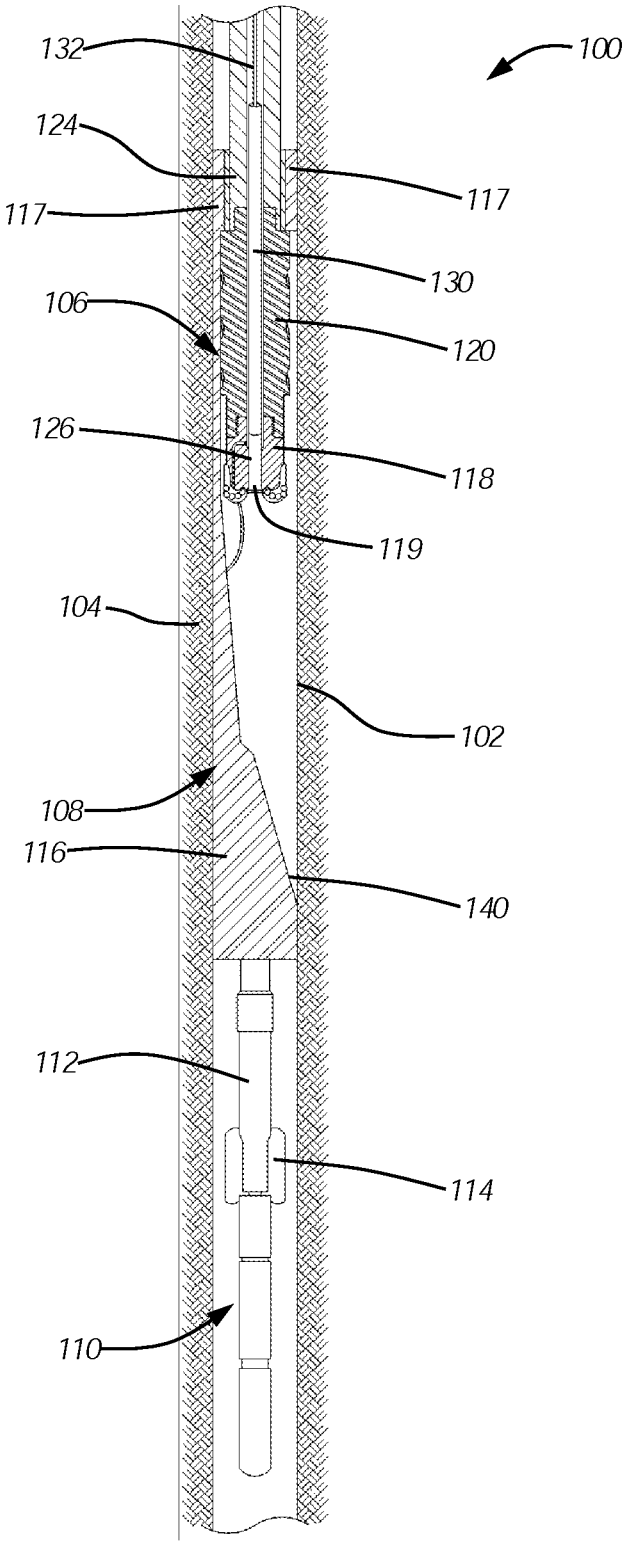
FIG. 1 illustrates a partial cross-sectional view of an example system for extracting a core sample from a rock formation, according to one or more implementations of the present disclosure.

In accordance with some aspects of the present disclosure, implementations herein relate to systems, assemblies and/or methods for extracting a core sample from a formation. More particularly, implementations disclosed herein may relate to systems, assemblies and/or methods for extracting a core sample from a lateral borehole or other deviated section of a wellbore. Further implementations may relate to extracting a core sample closely resembling the natural state of the formation, and of a size allowing for study and analysis, while minimizing or eliminating compaction, fracture, or other deformation of the core sample. More particularly still, implementations disclosed herein may relate to systems, assemblies and/or methods which include a coring bit coupled to a deflector, and in which a single trip may be used to anchor a deflector, drill a lateral borehole from a wellbore and extract a core sample therefrom, and retrieve the deflector and coring bit.

Some principles and uses of the teachings of the present disclosure may be better understood with reference to the accompanying description, figures and examples. It is to be understood that the details set forth herein and in the figures are presented as examples, and are not intended to be construed as limitations to the disclosure. Furthermore, it is to be understood that the present disclosure and implementations related thereto can be carried out or practiced in various ways and that aspects of the present disclosure can be implemented in implementations other than the ones outlined in the description below.

To facilitate an understanding of various aspects of the implementations of the present disclosure, reference will be made to various figures and illustrations. In referring to the figures, relational terms such as, but not exclusively including, "bottom," "below," "top," "above," "back," "front," "left," "right," "rear," "forward," "up," "down," "horizontal," "vertical," "clockwise," "counterclockwise," "inside," "outside," and the like, may be used to describe various components, including their operation and/or illustrated position relative to one or more other components. Relational terms do not indicate a particular orientation or position for all implementations. For example, a component of an assembly that is "below" another component while within a wellbore may be at a lower elevation while in a vertical portion of a wellbore, but may have a different orientation during assembly, or when the assembly is in a lateral or deviated portion, e.g., lateral or deviated borehole, of the wellbore, when outside of the wellbore, during manufacture, or at other times. Accordingly, relational descriptions are intended solely for convenience in facilitating reference to some implementations described and illustrated herein, but such relational aspects may be reversed, rotated, moved in space, placed in a diagonal orientation or position, placed horizontally or vertically, or similarly modified.

Relational terms may also be used to differentiate between similar components; however, descriptions may also refer to certain components or elements using designations such as "first," "second," "third," and the like. Such language is also provided for differentiation purposes, and is not intended limit a component to a singular designation. As such, a component referenced in the specification as the "first" component may for some but not all implementations be the same component that may be referenced in the claims as a "first" component. Furthermore, to the extent the specification or claims refer to "an additional" or "other" element, feature, aspect, component, or the like, it does not preclude there being exactly one, or more than one, of the additional element. Where the claims or specification refer to "a" or "an" element, such reference is not be construed that there is exactly one of that element, but is instead to be inclusive of other components and understood as "one or more" of the element. It is to be understood that where a component, feature, structure, or characteristic is included in a particular implementation, such component, feature, structure or characteristic is not required or essential unless explicitly stated in the description as being required for all implementations.

Meanings of technical and scientific terms used herein are to be commonly understood as by a person having ordinary skill in the art to which implementations of the present disclosure belong, unless otherwise defined. Implementations of the present disclosure can be implemented in testing or practice with methods and materials equivalent or similar to those described and/or disclosed herein.

Referring now to FIG. 1, an example coring system 100 is illustrated. The coring system 100 of FIG. 1 may be inserted within a wellbore 102 in a formation 104, and used to extract a core sample from the formation 104. In some implementations, the core sample extracted from the formation may be core sample removed from a lateral or deviated portion of the wellbore 102, such as a borehole or perforation, rather than from a vertical portion of the wellbore 102. Further, while a wellbore 102 in a formation 104 is illustrated, those skilled in the art will readily recognize that the systems, assemblies and/or methods described herein may be used in any hole drilled in a natural formation or manmade material.

In the particular implementation illustrated in FIG. 1, the coring system 100 is shown as including a coring assembly 106, a deflector assembly (e.g., a whipstock assembly) 108, and an anchor assembly 110, each of which are optionally intercoupled. More particularly, and as discussed in greater detail herein, the coring assembly 106 may be coupled to the deflector assembly 108, and the coring assembly 106, deflector assembly 108, and anchor assembly 110 may be collectively inserted and run into the wellbore 102, and lowered to a desired position. When at the desired location, the anchor assembly 110 may be secured in place. For instance, in this implementation, the anchor assembly 110 includes an anchor 112 and expandable slips 114 (shown here in a retracted state) that may engage the inner surface of the wellbore 102. The anchor assembly 110 may include any suitable construction, and may be integral with, or distinct from, the deflector assembly 108. In some implementations, a frictional or other engagement between the expandable slips 114 and the inner surface of the wellbore 102 may effectively hold the anchor 112 and the deflector assembly 108 at a desired axial position, and a desired angular orientation, or azimuth, within the wellbore 102.

The coring assembly 106 may be separable from, or movable relative to, the deflector assembly 108 in an implementation in which the coring assembly 106 is coupled to the deflector assembly 108 and/or the anchor assembly 110. By way of illustration, a selectively engageable latch or other mechanism may be used to selectively couple and/or decouple the coring assembly 106 relative to a deflector 116 of the deflector assembly 108. In other implementations, and as described in greater detail hereafter, a sacrificial element may be used to releasably couple the coring assembly 106 to the deflector assembly 108. For instance, once the anchor assembly 110 is secured at a desired axial and/or rotational position within the wellbore 102, axial and/or rotational movement of the coring assembly 106 may be used to break the sacrificial element, thereby decoupling the coring assembly 106 from the deflector 116, or otherwise allowing movement of the coring assembly 106 relative to the deflector 116.

While the coring assembly 106, deflector assembly 108, and anchor assembly 110 may be collectively run into the wellbore 102 to allow a single trip to insert, anchor, and use such assemblies, such an implementation is merely illustrative. In other implementations, for instance, the coring assembly 106 may be separate from the deflector assembly 108. In such an implementation, the anchor assembly 110 may be anchored in place. The deflector assembly 108 may be run into the wellbore 102 and secured in a desired position and orientation collectively with the anchor assembly 110, or run in and secured in place following insertion and/or anchoring of the anchor assembly 110. Thereafter, the coring assembly 106 may be run into the wellbore 102.

Regardless of whether the coring assembly 106 is coupled to the anchor assembly 110 and/or deflector assembly 108 to allow for single-trip extraction of a core sample, the coring assembly 106 may use the deflector assembly 108 to extract a core sample from a deviated or lateral section of the wellbore 102, e.g., a borehole through the side wall of the wellbore 102, as discussed hereafter. As shown in FIG. 1 and as better viewed in the enlarged view of FIG. 2, the coring assembly 106 may include a coring bit 118 for drilling into the formation 104 and extracting a core sample therefrom. The coring bit 118 may be coupled to a stabilizer 120 (e.g., using threaded coupler 122), which may in turn be coupled to an outer barrel 124. One or both of the stabilizer 120 and the outer barrel 124 may be components of the coring assembly 106. Core samples may collect within an opening within the coring bit 118, stabilizer 120 and/or outer barrel 124.

In particular, the coring bit 118 may include an opening 119 in a distal end portion thereof, which opening 119 may be in communication with a collection chamber 126 within the coring bit 118, stabilizer 120, and/or the outer barrel 124. The coring bit 118, stabilizer 120, and the outer barrel 124 may be coupled to a drill rig (not shown), e.g., via a drill string (not shown), that can rotate the coring bit 118, optionally by also rotating the stabilizer 120, outer barrel 124, and/or the drill string coupled to the outer barrel 124. As one or more cutters 128 on the coring bit 118 cut into the formation 104, i.e., through the side wall of the wellbore 102, materials from the formation 104 may collect within the collection chamber 126 to form a columnar core sample. When the coring bit 118 has cut deep enough to fill the collection chamber 126, or otherwise obtain a suitable or desired sample for study, the core sample can be removed. To remove the core sample, the entire coring assembly 106 may be withdrawn from wellbore 102.

Figure 2:
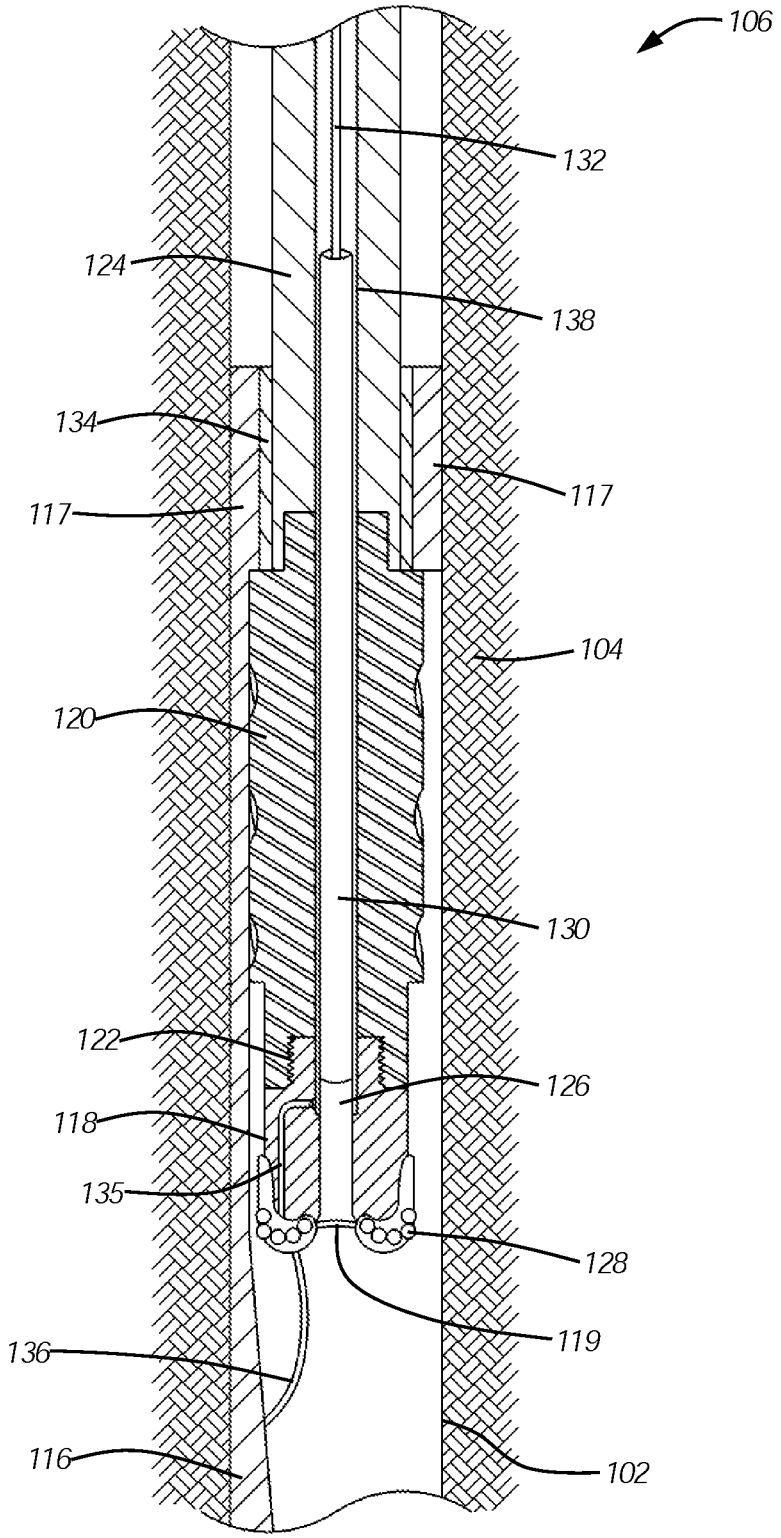
FIG. 2 illustrates an enlarged view of a coring assembly of the system of FIG. 1.

Removal of the coring assembly 106 may also remove the deflector assembly 108 and/or anchor assembly 110. FIGS. 1 and 2 illustrate an implementation in which the deflector 116 may include a collar 117. The collar 117 may be sized to allow the outer barrel 124 to be positioned therein. Optionally, the stabilizer 120, coring bit 118, or outer barrel 124 may have a portion with a diameter larger than an inner diameter of the collar 117. As a result, as the coring assembly 106 is drawn upward for removal, the coring assembly 106 may move toward the collar 117. A distal end portion of the collar 117 may act as a shoulder that is engaged by the coring assembly 106 (e.g., by stabilizer 120 in FIGS. 1 and 2). Pulling upward on the coring assembly 106 may release the anchor assembly 110 and allow the deflector assembly 108 and anchor assembly 110 to be removed from the wellbore 102 along with the coring assembly 106.

In another implementation, however, a core sample may be obtained and removed without corresponding removal of the coring assembly 106 and/or without removal of the deflector assembly 108. For instance, in this particular implementation, an inner barrel 130 may be located or positioned within the collection chamber 126. As the coring bit 118 cuts a lateral section into the side wall of wellbore 102 (or otherwise drills the wellbore 102), the core sample may collect inside a collection chamber of the inner barrel 130. The inner barrel 130 may be selectively removable. As shown in FIGS. 1 and 2, a retrieval wire 132 may be coupled to an upper, proximal end portion of the inner barrel 130. When the inner barrel 130 is filled or otherwise has a core sample of a desired size, an operator may use the retrieval wire 132 to remove the inner barrel 130 and extract the core sample. If additional core samples are desired, the inner barrel 130 (or a different inner barrel 130) may be lowered towards the coring bit 118 (and seat with or within outer barrel 124), and drilling may continue until another core sample is obtained.

A core sample collected within the collection chamber 126 of the outer barrel 124 or the inner barrel 130 may have any suitable size and shape. For instance, as discussed herein, a length of the collected core sample may vary from a few inches to many hundreds of feet. The width of the core sample may also vary. By way of example, the opening 119 and collection chamber 126 (or the interior of the inner barrel 130) may have a width from about one inch (25 mm) to about four inches (102 mm), to about six inches (152 mm) or more. In a more particular implementation, the inner barrel 130 and/or outer barrel 124 may collect a core sample having a width greater than two inches (51 mm), which may facilitate measuring porosity, permeability and other properties of the formation 104. Of course, in other implementations, the core sample may have a width or diameter less than one inch (25 mm) or greater than four inches (102 mm). Moreover, while the core sample may have a circular cross-sectional shape in some implementations, the outer barrel 124 and/or inner barrel 130 may in other implementations facilitate collection of a columnar core sample having a square, elliptical, trapezoidal, or other cross-sectional shape.

The coring assembly 106 may include any number of additional or other components, such as various fasteners, bearings, or the like. For instance, the inner barrel 130 and/or collection chamber 126 may include fasteners to secure the inner barrel 130 in place within the outer barrel 124, stabilizer 120, and/or the coring bit 118. Such fasteners may be selectively engageable and disengageable to allow removal of the inner barrel 130 independent of the outer barrel 124 or the coring assembly 106. Fasteners may also be used to secure other components, including the stabilizer 120 to the outer barrel 124 and/or the outer barrel 124 to a drill string (not shown).

In one or more implementations, the deflector assembly 108 may include a bearing 134 coupled to the collar 117. The bearing 134 may be positioned, e.g., radially, between the collar 117 and the coring assembly 106, as shown in the implementation of FIGS. 1 and 2. The bearing 134 may allow or facilitate rotation of the outer barrel 124 or other component of the coring assembly 106 within or relative to the collar 117. In at least some implementations, rotation of the coring assembly 106 as facilitated by the bearing 134 may allow a coupler to be released and/or a sacrificial element to be broken/severed (e.g., to selectively detach the coring assembly 106 from the deflector assembly 108). The bearing 134 may generally include one or more bearings or bushing surfaces to reduce friction as the coring assembly 106 rotates within the wellbore 202 and optionally within or relative to all or a portion of the deflector assembly 108. An example bearing 134 may include a thrust bearing, roller bearing, spherical bearing, or other bearing, or some combination thereof. In an example implementation using a spherical bearing, the bearing 134 may allow angular deflection of the outer barrel 124 while the outer barrel 124 and coring bit 118 travel along an inclined surface of the deflector assembly 108 to drill a lateral section into the side wall of wellbore 102. A spherical bearing may also be used to support axial, sliding motion of the outer barrel 124 as coring assembly 106 moves in an upwardly or downwardly directed path.

As also best shown in FIG. 2, an example coring assembly 106 may also include one or more hydraulic lines 135, 136, which provide a portion of a hydraulic fluid pathway. In this particular implementation, fluid may be pumped through a channel 138 in the outer barrel 124, and directed towards the coring bit 118. The channel 138 of this implementation is shown as surrounding the collection chamber 126; however, in other implementations the channel 138 may be otherwise located or omitted entirely. As fluid is sent through the channel 138, it may pass into one or more hydraulic lines 135 within the coring bit 118 or outer barrel 124. Such fluid may then be used as a cutting fluid to facilitate cutting by the coring bit 118.

In another implementation, fluid passing through the hydraulic line 135 and/or the channel 138 may be used for additional or other purposes. For instance, the implementation shown in FIG. 2 illustrates an additional hydraulic line 136 disposed at least partially below the coring bit 118. The illustrated hydraulic line 136 is shown as extending to the deflector 116, but may extend to any desired location, and can be used for any suitable purposes. Thus, a hydraulic fluid pathway may include channel 138, hydraulic lines 135, 136 and other components providing fluid communication therewith. In some implementations, and referring again to FIG. 1, the coring assembly 106 may be coupled directly or indirectly to an anchor assembly 110, and one or more expandable slips 114 may be selectively expanded or retracted using hydraulic fluid supplied by the hydraulic lines 135, 136. When expanded, the expandable slips 114 may engage the wellbore 114 and anchor the deflector 116 in place. Thereafter, the coring assembly 106 may be selectively detached from the deflector 116 to begin a coring process.

Figure 3:
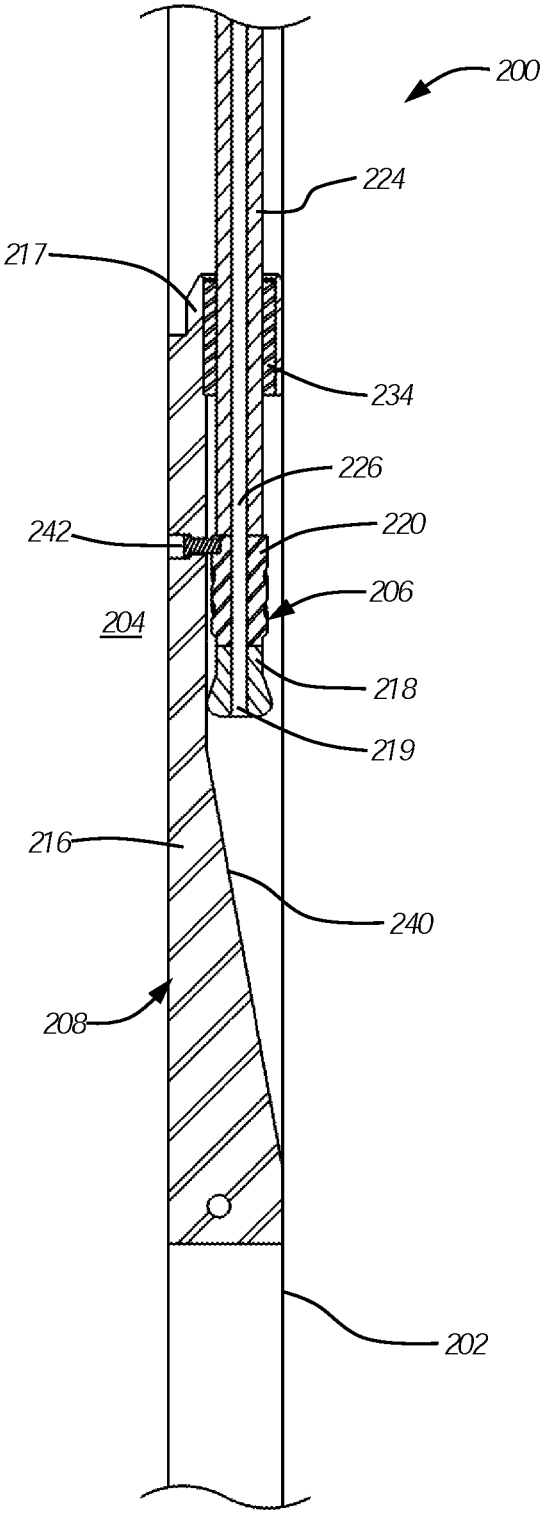
FIG. 3 illustrates a cross-sectional view of another coring system for extracting a lateral core sample, the coring system including a coring assembly and deflector assembly for one-trip setting of the deflector and extraction of the core sample.
Figure 4:
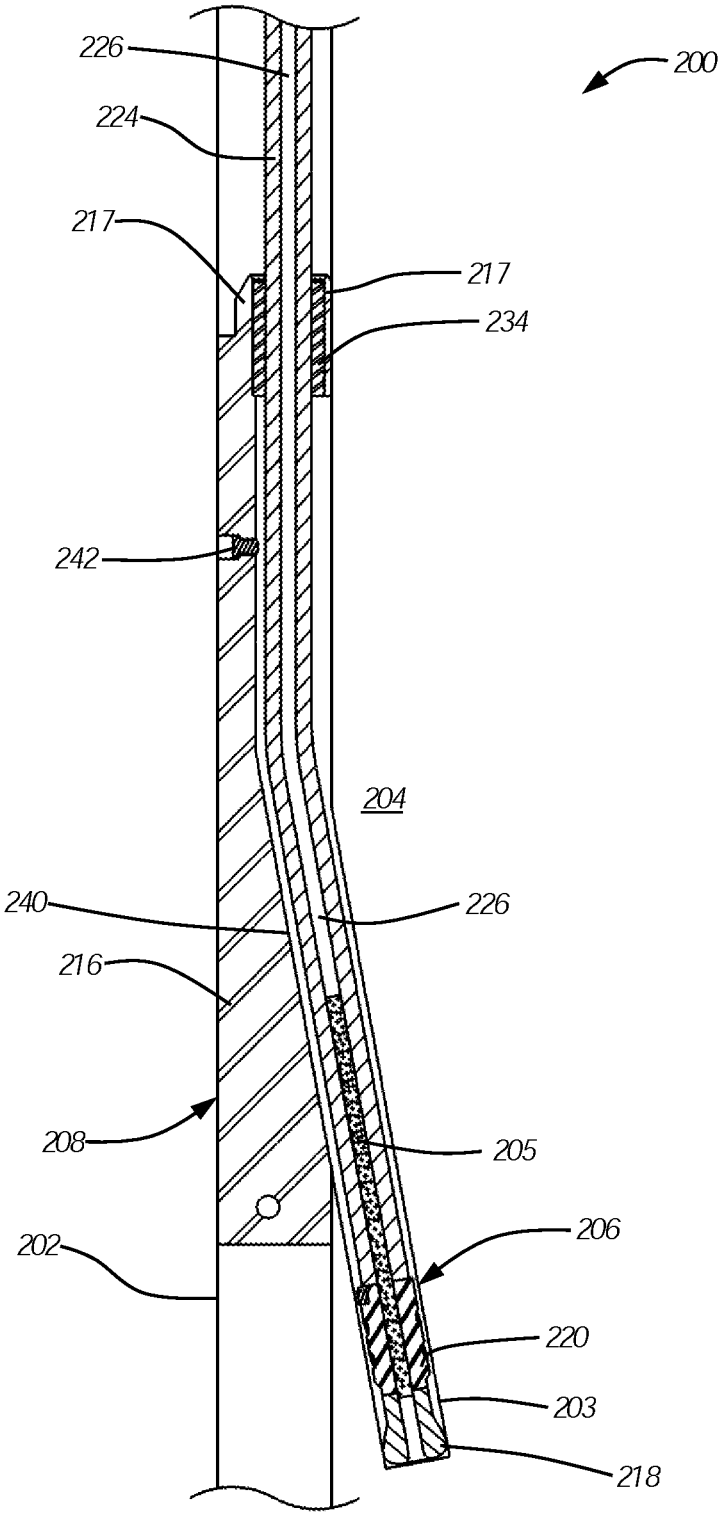
FIG. 4 illustrates the coring system of FIG. 3, with the coring assembly deflected laterally to extract the lateral core sample, according to one or more implementations of the present disclosure.
Figure 5:
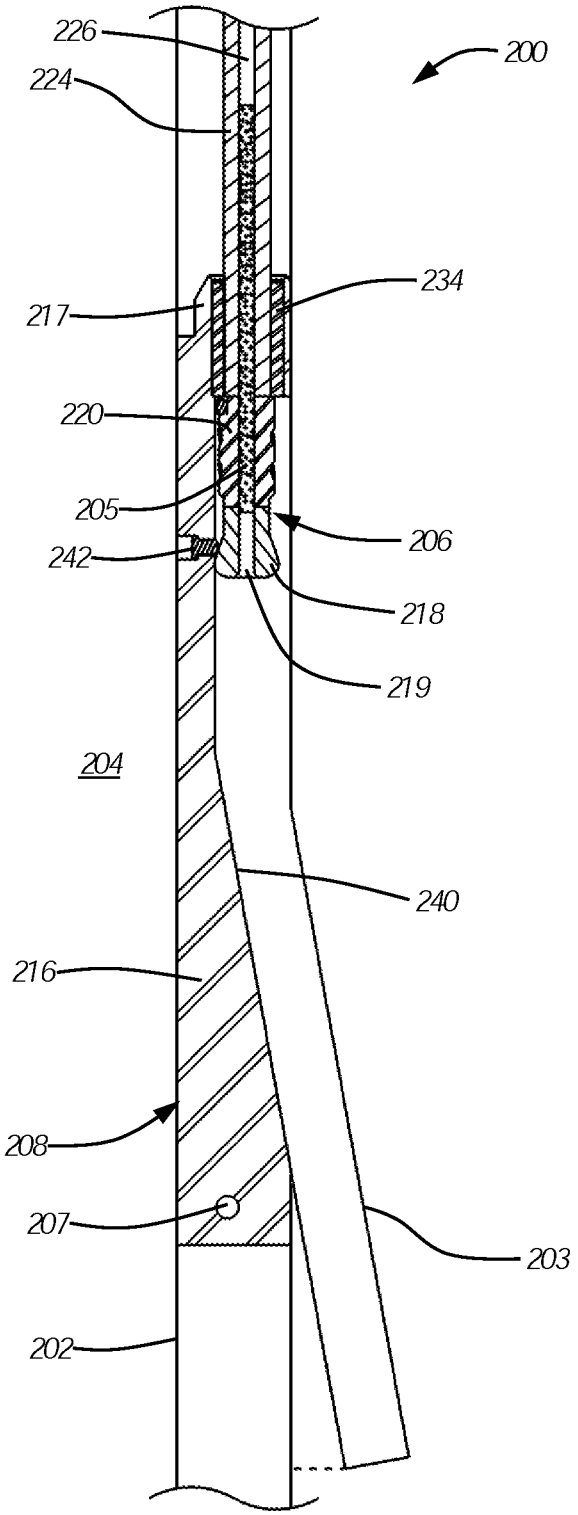
FIG. 5 illustrates the coring system of FIGS. 3 and 4, with the coring assembly retracted from a lateral section for extraction of the coring assembly and core sample from the hole, in accordance with one or more implementations of the present disclosure.

More particularly, as noted above, some implementations of the present disclosure relate to using a coring system to extract a core sample from a lateral section, e.g., borehole, or perforation within a side wall of a wellbore 102. Such coring system may employ a single trip to insert and anchor a deflector assembly and to obtain the core sample. Some coring systems may also allow uncoupling and retrieval of the deflector assembly and any corresponding anchor assembly in the same, single trip. FIGS. 3-5 further illustrate in greater detail an example single-trip coring system 200 while extracting a lateral core sample. In particular, FIGS. 3-5 illustrate the coring system 200 at various stages within a method that may be used to run the coring system 200 in a wellbore 202, drill a lateral section 203 off of the wellbore 202, obtain a core sample 205, and remove the coring assembly 206 and/or deflector assembly 208. In general, the coring system 200 may include components similar or identical to those of the coring system 100 of FIGS. 1 and 2. However, to avoid unnecessarily obscuring aspects of the implementation in FIGS. 3-5, various aspects of redundant or similar features may not be described or shown again in detail, but it will be readily appreciated by a person skilled in the art that the various features of FIGS. 1 and 2 (e.g., an anchor assembly having expandable slips, an inner barrel, hydraulic fluid lines, channels or pathways, etc.) may be incorporated into the implementation of FIGS. 3-5. Accordingly, the discussion and components of FIGS. 1 and 2 may be incorporated into the discussion and implementation of FIGS. 3-5.

As shown in FIGS. 3-5, the coring system 200 may also include a coring assembly 206 and corresponding deflector assembly 208. In general, a deflector 216 of the deflector assembly 208 may be used to deflect the coring assembly 206 laterally to create a deviated or lateral section in the wellbore 202 (see FIG. 4). As the deflection occurs, the coring assembly 206 may drill laterally into the formation 204 and extract a core sample from the lateral section of the wellbore 202, as opposed to a vertical or other primary section of the wellbore 202.

In FIGS. 3-5, the deflector 216 (e.g., a whipstock) is shown as including a wedge-shaped section having an inclined surface 240. The particular incline of the inclined surface 240 may be varied in any manner known to those skilled in the art. For instance, relative to the longitudinal axis of the vertical portion of the wellbore 202, the inclined surface 240 may extend at an angle between about 1° and about 10°, although such an implementation is merely illustrative. In a more particular implementation, the angle may be between about 2° and about 6°. In still another example implementation, the angle of the inclined surface 240 may be about 3°. Of course, in other implementations, the inclined surface 240 may be inclined at an angle less than about 1° or more than about 10°. Further, while the inclined surface 240 may have a single segment extending at a generally constant incline, in other implementations the inclined surface 240 may have multiple segments. By way of example, the inclined surface 240 may have at least two segments, each with a different degree of incline. In other implementations, however, the inclined surface 240 may include three or more segments, any or all of which may have a different incline relative to other segments. Optionally, the inclined surface 240 may also have an element of twist configured to direct the coring bit 218 and cause it to rotate as it advances along the inclined surface 240.

More particularly, and regardless of the particular construction of the deflector 216, as the coring assembly 206 is detached from the deflector 216, or when inserted into the wellbore following anchoring of the deflector assembly 208, the coring bit 218 may come into contact with (and be guided by) the inclined surface 240. Because of the angle on the inclined surface 240, further downward or distally-directed movement of the coring assembly 206 may cause the coring bit 218 to travel across the inclined surface 240, and gradually move towards the side wall of the wellbore 202. The coring bit 218 may optionally rotate as it moves along the inclined surface 240 and/or as it engages the side wall of the wellbore 202. Using cutting elements (e.g., cutters 128 in FIG. 2), the coring bit 218 may then cut laterally, e.g., into the side wall, from the wellbore 202. As best shown in FIG. 4, when the coring bit 218 advances a sufficient distance along the inclined surface 240, the corresponding lateral movement can cause the coring bit 218 to form or move into a lateral or deviated section 203 that extends or deviates from the primary wellbore 202.

As discussed herein, when the coring bit 218 drills into or otherwise forms the lateral section or borehole 203 of the wellbore 102, rock and other materials of the formation 204 may pass through an opening 219 in the coring bit 218 and collect within a collection chamber 226. As shown in FIG. 4, a core sample 205 has been extracted from the formation 204 and is located within the collection chamber 226. In this implementation, the collection chamber 226 may extend from the coring bit 218 to and through an outer barrel 224, which may optionally also pass through a stabilizer 220. In some implementations, the collection chamber 226 may be formed in other or additional components, such as an inner barrel 130 as discussed previously.

One aspect of an example coring system 200 of the present disclosure may include the ability to extract a core sample 205 from a deviated portion 203 of a wellbore 202, with such core sample 205 having any desired length. Indeed, in some implementations, a core sample 205 extracted using the coring system 200 may extend many hundreds of feet (e.g., 2000 feet, 3000 feet, or more) into the lateral section 203 of the wellbore 202. In other implementations however, the core sample 205 may be much shorter (e.g., less than 2000 feet in some implementations, less than 200 feet in other implementations, and less than 50 feet in still other implementations). As an example, if an operator of the coring system 200 wishes to obtain a core sample 205 of the formation 204 that is three feet (0.9 m) away from the wellbore 202, as measured in a direction perpendicular to the wellbore 202, and the lateral section or borehole 203 extends at a constant angle of 3° relative to the longitudinal axis of the wellbore 202, a core sample 205 of about sixty feet (18.3 m) should provide the desired information. Of course, if the angle of the lateral section 203 is greater or smaller than 3°, or varies along its length, or if the desired portion of the formation 204 to be sampled is nearer or farther from the wellbore 202, the length of the core sample 205 may vary. Further, while the illustrated wellbore 202 is shown as vertical, the wellbore 202 may not be vertical. Nevertheless, the coring system 200 may be used to drill a lateral, deviated section, e.g., borehole 203, off of a non-vertical wellbore (not shown) to obtain a core sample 205.

While some formations may have relatively constant properties over large spatial distances, other formations may show significant deviations over short spatial distances. Accordingly, by extending the coring assembly 206 laterally from the primary portion of the wellbore 202, a core sample 205 may therefore be obtained to capture formation properties farther from the wellbore 202. Gradients and other changes in properties may therefore be analyzed and determined. Further, because core samples 205 may be of virtually any continuous length, core sample 205 may be relatively unfractured and large enough to allow for simplified analysis. Further still, as continuous core samples are obtained through a coring bit 218, the coring system 200 may operate with few or no explosives that could otherwise create a fractured or compacted core sample 205.

While the core sample 205 may be obtained from a lateral section 203 that extends a relatively short perpendicular or longitudinal distance from the primary portion of the wellbore 202, the length may be much larger. Indeed, the lateral section 203 may extend for potentially hundreds of feet as discussed herein. Optionally, to facilitate lateral drilling of the lateral section or borehole 203, the coring assembly 206 may use directional drilling equipment. While not shown in FIGS. 3-5, such directional drilling equipment may include steerable drilling assemblies that include, but are not limited to, a bent angle housing to direct the angle of drilling during drilling of the lateral section 203. The directional drilling equipment may employ other directional control systems that include, but are not limited to, rotary steerable systems. Example rotary steerable systems may include hydraulically controlled pads, deflecting rods, or a variety of other features and components known to those skilled in the art that are used to push, point, or otherwise control a drilling direction.

More particularly, FIGS. 3-5 illustrates a single-trip coring system 200 in which the coring assembly 206 may be selectively coupled to the deflector assembly 208. In this particular implementation, the coring assembly 206 and deflector assembly 208 may be coupled in a manner that allows the coring assembly 206 to be run into the wellbore 202 at the same time as the deflector assembly 208.

The coring assembly 206 and deflector assembly 208 may be placed in the wellbore 202, and lowered to a desired location (see FIG. 3). The deflector assembly 208 may include a deflector (e.g., whipstock) 216 with an inclined surface 240. When the inclined surface 240 is oriented in a direction corresponding to a desired trajectory for a lateral section or borehole 203 of the wellbore 202, the deflector assembly 208 can be anchored in place. Following anchoring of the deflector assembly 208, the coring assembly 206 can be separated from the deflector assembly 208 and moved (or guided) along the length of the inclined surface 240 to create the lateral section 203 of the wellbore 202 and to take a core sample 205 (see FIG. 4).

In the particular implementation shown in FIGS. 3 and 4, a sacrificial element 242 may couple the coring assembly 206 to the deflector assembly 208. The illustrated sacrificial element 242 may extend between the deflector 216 and one or more components of the coring assembly 206. More particularly, the illustrated sacrificial element 242 may extend between the deflector 216 and the stabilizer 220; however, in other implementations the sacrificial element 242 may couple to other components such as, but not limited to, the coring bit 218, the outer barrel 224, a collar 217, a drill string (not shown), or some other component.

In operation, the sacrificial element 242 may be designed to break or fail when a sufficient load is placed thereon. For instance, once the deflector 216 is anchored in place, an axial load may be placed on the outer barrel 224 of the coring assembly 206 (e.g., by loading a drill string). The anchored deflector 216 may be configured to have a higher resistance to an axial load than the sacrificial element 242, such that when the load exceeds the maximum force allowed by the sacrificial element 242, the sacrificial element 242 may break but the deflector 216 may remain anchored in place.

In another implementation, the coring assembly 206 may rotate to break the sacrificial element 242. By way of illustration, the coring bit 218, stabilizer 220, and/or outer barrel 224 of the coring assembly 206 may be configured to rotate to drill a lateral section 203 of the wellbore 202. In this implementation, a bearing 217 may be disposed between a collar 217 of the deflector 216 and an outer barrel 224 of the deflector assembly 208, as previously described with respect to the implementation of FIGS. 1 and 2. The bearing 217 may allow the coring assembly 206 to rotate independent of the deflector assembly 208, particularly once the deflector assembly 208 is anchored in place. When the deflector assembly 208 is anchored, a rotational force may be applied to the outer barrel 224, thereby causing the outer barrel 224 (and potentially the stabilizer 220 and/or coring bit 218) to rotate. With sufficient rotational force, the sacrificial element 242 may break. Regardless of whether the sacrificial element 242 breaks as a result of axial loading, rotation of the coring assembly 206, or some other manner, the coring assembly 206 may break free or otherwise be released from the deflector assembly 208 to allow axial movement of the coring assembly 206 relative to the deflector assembly 208.

The sacrificial element 242 may take any number of different forms. In FIGS. 3 and 4, the sacrificial element 242 may be a shear screw or break bolt configured to fail or be severed when a load is applied to translate or rotate the coring assembly 206 relative to the deflector assembly 208 (e.g., when the deflector assembly 208 is anchored). In other implementations, the sacrificial element 242 may include a notched tab configured to break or sever where stress concentrations form at notches. In still other implementations, other sacrificial elements or non-sacrificial elements readily known to those skilled in the art may be used. For instance, the sacrificial element 242 may be replaced by other structures (not shown), such as a selectively engageable latch or coupler that allows selective decoupling and/or reengagement of the coring assembly 206 relative to the deflector assembly 208, even without breaking or otherwise sacrificing the latch or coupler.

Once the sacrificial element 242 is broken or otherwise released, an operator of the coring system 200 may move the coring assembly 206 downwardly, further into the wellbore 202, as shown in FIG. 4. As discussed above, upon doing so, the coring assembly 206 may move along an inclined surface 240 of the deflector system 208 to form or be positioned within a lateral section 203 deviating from the wellbore 202. When the coring assembly is moved downwardly while rotating, the coring bit 218 may progressively cut a lateral section 203 that deviates laterally relative to a primary or other portion of the wellbore 202.

As the coring bit 218 cuts into the formation 204 and forms the lateral section 203 of the wellbore 202, the coring bit 218 may extract the core sample 205 from the formation 204. When the desired core samples have been obtained, an operator of the coring system 200 may stop the coring assembly 206 from continuing to drill the lateral section 203, and may remove the core sample 205. As shown in FIG. 5, the coring assembly 206 may be removed from the lateral section 203 of the wellbore 202 by using an upwardly directed force that pulls the outer barrel 224, stabilizer 220, and coring bit 218 out of the lateral section 203. The lateral section 203 may remain after removal of the coring assembly 206. In some embodiments, the lateral section 203 may collapse, wash out, or cave in to join the primary or other portion of the wellbore 202. The dashed lines on the lateral section 203 illustrate an example of the lateral section 203 caving in to join the primary portion of the wellbore 202.

In the implementation shown in FIGS. 3-5, removal of the coring assembly 206 may also be used to remove the deflector assembly 208. As shown in FIG. 5, the outer barrel 224 may pass through an opening within a collar 217 of the deflector assembly 208. The collar 217 may be sized such that the interior diameter of the collar 217 is less than an exterior diameter of the stabilizer 220, coring bit 218, or a portion of the outer barrel 224. Consequently, when the coring assembly 206 moves upwardly as shown in FIG. 5, an upper surface of the stabilizer 220 (or other component) may engage a lower surface of the collar 217. The collar 217 may thus act as a stop ring by restricting all or a portion of the coring assembly 206 from moving upwardly past the lower surface of the collar 217. To move the coring assembly 206 upwardly, the deflector assembly 208 may therefore also be unanchored and released from engagement with the side wall of the wellbore 202. A pulling force applied upwardly to the outer barrel 224 (e.g., by a drilling rig pulling upwardly on a drill string coupled to the outer barrel 224) may then also pull the deflector assembly 208 and any corresponding anchor assembly (not shown) upwardly and ultimately out of the wellbore 202.

In implementations in which the deflector assembly 208 is anchored in place, the deflector assembly 208 may be released in any suitable manner. A more particular discussion of one manner for releasing the anchored deflector assembly 208 is described in additional detail with respect to FIGS. 15-17, although the anchored deflector assembly 208 may be released in any manner known to those skilled in the art.

The collar 217 and stabilizer 220 or other component of the coring assembly 206 may be formed or constructed in any manner known to those skilled in the art. For instance, an engagement portion of the coring assembly 206 (e.g., the stabilizer 220) may directly engage the collar 217. In other implementations, however, the engagement portion of the coring assembly 206 may engage other components. FIG. 5 shows the stabilizer 220 engaging the distal end portion of the bearing 234. Nevertheless, other implementations may have the stabilizer 220, coring bit 218, outer barrel 224, or another component of the coring assembly 206 directly engaging the collar 217.

As should be readily appreciated by those skilled in the art in view of the disclosure herein, the collar 217 may be integral with the deflector 216. In another implementation, the collar 217 may be mechanically fastened to the deflector 216. Regardless of the particular manner in which the collar 217 and deflector 216 are coupled or secured together, the collar 217 or another similar component may optionally restrict and potentially prevent independent axial and/or rotational movement of the coring assembly 206 in one or more directions along the wellbore 202. Thus, while the coring assembly 206 may move rotationally and/or downward axially within the wellbore 202 when the coring assembly 206 is below or downhole of the collar 217 (and while the collar 217 optionally remains at a relatively static axial and/or rotational position), the collar 217 may restrict or prevent rotational and/or upwardly directed axial movement of the coring assembly 206 once the collar 217 and coring assembly 206 become engaged (e.g., at a distal end portion of the coring assembly 206, such as collar 217 or bearing 234). In some implementations, such as when the deflector assembly 208 is anchored, the deflector assembly 208 may restrict or prevent upwardly directed or rotational movement of the coring assembly 206.

A deflector assembly 208 may include any of the components discussed above; however, the deflector assembly 208 is not limited to such an implementation and may include any number of additional or other features or components. For instance, in some implementations, the deflector assembly 208 may include a hinge connector (not shown) pivotally coupled to the deflector 216 and an anchor (e.g., anchor 110 of FIG. 1). A hinge connector or other similar component may, for instance, connect to the deflector 216 using a pivot pin (not shown) within the pivot opening 207 shown in FIG. 5.

Another implementation of the present disclosure is illustrated and described relative to FIGS. 6-14. In particular, FIGS. 6-14 illustrate various views of an example coring system 300 that may be tripped into a wellbore 302 and used to extract a core sample 305 from a formation 304. The coring system 300 optionally may be used to insert and anchor a deflector assembly 308 in the same trip during which a core sample 305 is captured and/or extracted by a coring assembly 306. Optionally, the single, same trip may also be used to release and/or remove the deflector assembly 308 and/or an anchor assembly 310 (see FIG. 9). The coring system 300 of FIGS. 6-14 may also include features of the coring systems 100 and 200 of FIGS. 1-5. Accordingly, to avoid unnecessary duplication, various aspects from similar, identical, or redundant features may not be described or shown again in detail, but it should be readily appreciated by persons skilled in the art that various features of FIGS. 1-5 may be incorporated into the implementation of FIGS. 6-14.

Figure 6:
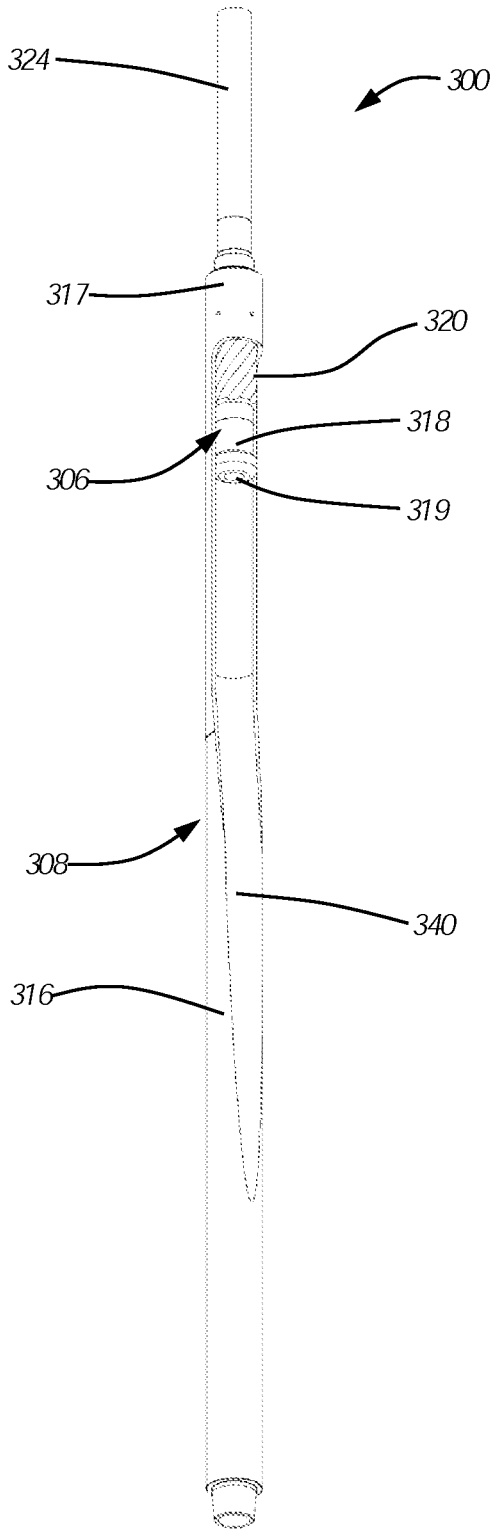
FIG. 6 illustrates an isometric view of another example coring system for extracting a lateral core sample, the coring system including a coring assembly coupled to a whipstock for single trip setting of the whipstock and extraction of the core sample.

FIG. 6 illustrates an isometric view of an example coring system 300 that includes a coring assembly 306 coupled to a deflector assembly 308. In this particular implementation, the deflector assembly 308 may include a deflector (e.g., a whipstock) 316. In accordance with at least one implementation of the present disclosure, the deflector 316 may include a whipstock having an inclined surface 340 that is used to direct or guide a coring bit 318 of the coring assembly 306 against an interior or side wall of a primary wellbore (not shown) in order to form, e.g., by drilling, a lateral borehole or section that deviates from the primary wellbore.

The coring assembly 306 may itself include any number of different components. A coring bit 318 may be included and configured to cut into a formation and extract a core sample. In at least some implementations, an opening 319 may be located at a distal end portion of the coring bit 318. As the coring bit 318 cuts into the formation 304, a portion of the formation 304 may be inserted through the opening 319 and captured as the core sample. Optional additional features may include a stabilizer 320 and one or more barrels (e.g., barrel 324). In this particular implementation, the stabilizer 320 may be located near the coring bit 318. In some implementations, the stabilizer 320 may be used to minimize downhole torque, reduce damage to a side wall, enhance fluid circulation within the wellbore (or lateral borehole thereof), reduce unintentional sidetracking, reduce vibrational forces, or perform any number of other functions. Additionally, while a single stabilizer 320 is illustrated, there may be multiple stabilizers positioned at any of a number of locations relative to the coring bit 318.

The barrel 324 may be coupled to the stabilizer 320 and/or the coring bit 318. The barrel may serve any number of purposes. For instance, the barrel 324 may couple to a drill string (not shown). Using the drill string, the coring system 300 may then be tripped into the wellbore 302. In some implementations, there may be multiple barrels. By way of example, barrel 324 may be an outer barrel, and there may be one or more inner barrels. FIGS. 7-14 illustrate example implementations where the barrel 324 is an outer barrel and in which an inner barrel 330, or core barrel, is located within the barrel 324. The inner barrel 330 optionally provides a collection chamber in which a core sample may be collected for extraction.

In some implementations, the barrel 324 and/or one or more other barrels or components, have an interior opening or bore extending longitudinally therethrough. As noted above, such an opening or bore may allow a core sample to be collected therein. A core sample extracted using the coring bit 318 may be collected within the opening or bore formed in the barrel 324 (and optionally in openings or bores within the coring bit 318 and/or stabilizer 320). Additionally, some implementations contemplate that the same or another opening or bore may allow for fluid to flow therethrough. Such fluid may be useful in a number of applications. For instance, the fluid may be used as cutting fluid to reduce wear and/or enhance the cutting efficiency of the coring bit 318. Optionally, the fluid could also or additionally be used to set a hydraulic anchor coupled to the deflector assembly 308. Where fluid flows through the barrel 324, it may flow through a center of the barrel 324 or in another manner. For example, when an inner barrel 330 is included, fluid may optionally flow in an interior cavity or annulus between an inner wall of the barrel 324 and the outer wall of the inner barrel 330.

As discussed herein, the coring assembly 306 and the deflector assembly 308 are optionally coupled for single-trip use. In this implementation, a collar 317 is illustrated as being formed on the deflector assembly 308, and optionally at or near a proximal or upward end portion thereof. The collar 317 may have an interior opening or bore passing longitudinally therethrough, which opening or bore may be sized to allow the barrel 324, stabilizer 320 and/or coring bit 318 to pass therethrough. In one or more implementations, the opening or bore within the collar 317 may be sized to restrict passage of one or more of the barrel 324, stabilizer 320, or coring bit 318. In FIG. 6, for example, the barrel 324 may be able to pass through the opening in the collar 317; however, the stabilizer 320 and/or coring bit 318 may have an outer diameter larger than the inner diameter of the collar 317. Accordingly, the coring assembly 306 may allow movement downward relative to the deflector assembly 308 by passing the barrel 324 through the collar 317. However, as upward movement of the coring assembly 306 relative to the deflector assembly 308 draws the stabilizer 320 or coring bit 318 into contact with the distal end portion of the collar 317, the collar 317 can act as a shoulder engaging the stabilizer 320 or coring bit 318 and restricting further upward motion. Engaging the stabilizer 320, coring bit 318 or another component against the collar 317 may be used to retrieve the deflector assembly 308 when a core sample is also retrieved.

FIGS. 7-14 provide cross-sectional views of the coring system 300 of FIG. 6, and provide additional detail of how some aspects of a particular implementation of the present disclosure may allow for single trip insertion, core sample extraction, and removal of the coring system 300. It should be appreciated, however, that the coring system 300 is merely illustrative, and that other implementations are contemplated that may also allow single trip use of the coring system 300, or which may allow or even require multiple trips to insert or set a deflection assembly and coring assembly, obtain and extract a core sample, or remove a deflection assembly.

Figure 7:
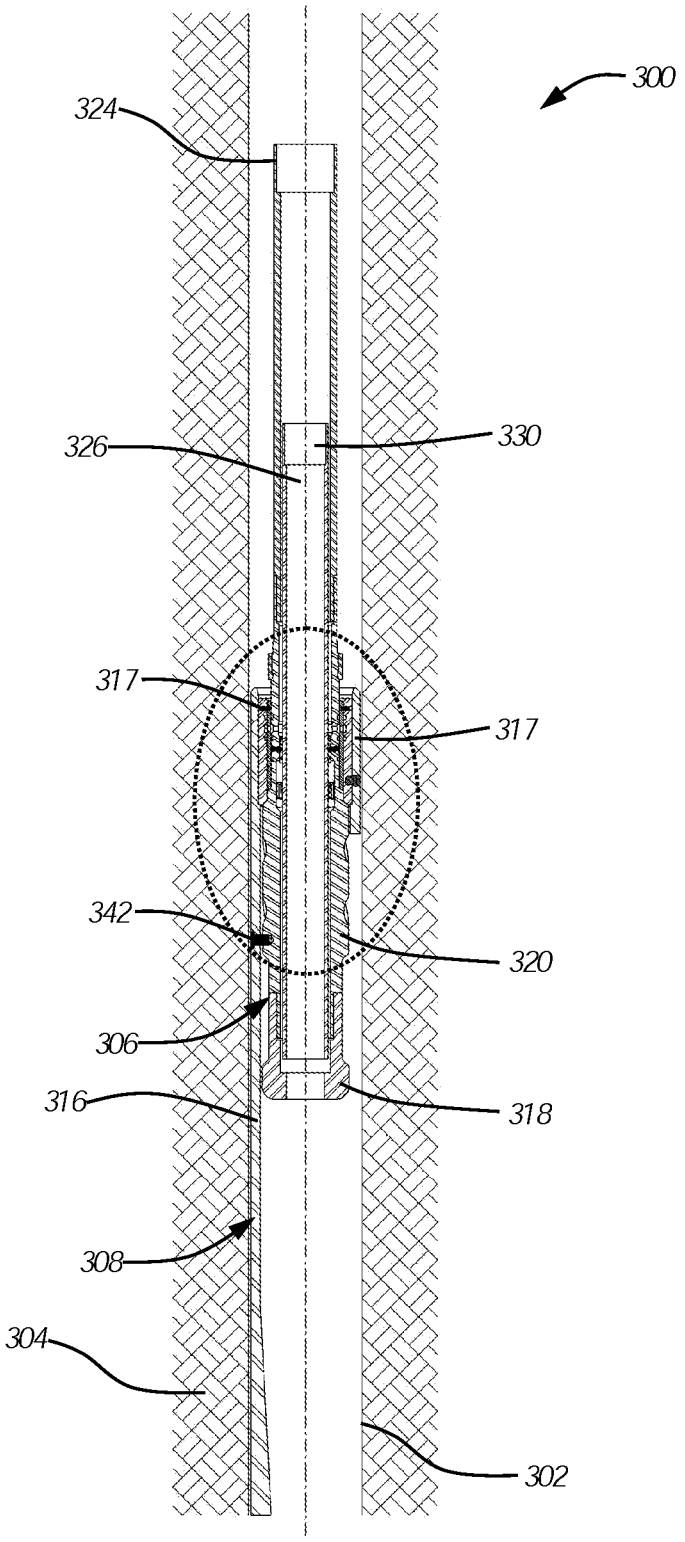
FIG. 7 is a partial cross-sectional view of the coring system of FIG. 6 when the coring system is tripped into a wellbore, in accordance with one or more implementations of the present disclosure.

FIG. 7 illustrates a cross-sectional view of the various components of the coring system 300 of FIG. 6, and particularly illustrates the coring assembly 306 in additional detail. The deflection assembly 308, including a deflector 316, such as a whipstock, is only partially illustrated in order to allow a more clear view of the components of the coring assembly 306.

The coring assembly 306 includes various components, including a coring bit 318 coupled to a stabilizer 320. Each of the coring bit 318 and stabilizer 320 includes a bore that communicates with a collection chamber 326. The collection chamber 326 may extend through all or a portion of the stabilizer 320, coring bit 318, and/or a barrel 324 coupled to the stabilizer 320. The collection chamber 326 may be used to store a core sample (e.g., core sample 305 of FIGS. 13 and 14) extracted from a formation 304. The core sample 304 may be obtained from a vertical or primary portion of a wellbore 302; however, implementations contemplate using the coring system 300 of FIG. 7 to extract a core sample from a lateral borehole as discussed herein.

Figure 8:
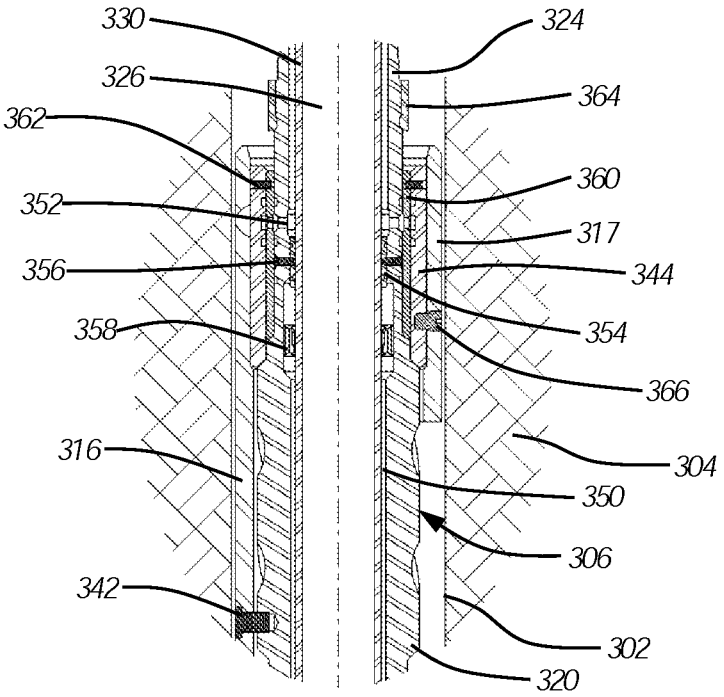
FIG. 8 is an enlarged view of a portion of the implementation illustrated in FIG. 7.

The particular implementation of FIG. 7 has the coring system 300 configured to trip into the wellbore 302. In this particular implementation, the coring assembly 306 may be coupled to the deflector 316 of the deflector assembly 308 to allow collective insertion of the coring assembly 306 and deflector assembly 308. FIG. 8 illustrates an enlarged view of the portion of FIG. 7 enclosed in the phantom lines, and further illustrates an example mechanism for coupling the coring assembly 306 to the deflector assembly 308.

FIG. 8 illustrates an example implementation in which the stabilizer 320 couples to the barrel 324 and to the deflector 316. In at least one implementation, the coupler 342, e.g., a sacrificial element such as a shear pin or break bolt, between the stabilizer 320 and the deflector 316 is configured to be temporary or selectively disengaged. The sacrificial element 342 may couple the deflector 316 to one or more components of the coring assembly 306. More particularly, the illustrated sacrificial element 342 may couple the deflector 316 to the stabilizer 320; however, in other implementations the sacrificial element 342 may couple to other components such as, but not limited to, the coring bit 318, the barrel 324, a collar 317, a drill string (not shown), or some other component.

In operation, the sacrificial element 342 may couple the deflector 316 and stabilizer 320 to restrict the stabilizer 320 from moving axially and/or rotationally relative to the deflector 316. Thus, when the coring system 300 is inserted into the wellbore 302, the stabilizer 320 and the coring system 306 may remain at a relatively static location relative to the deflector 316. The sacrificial element 342 may, however, be designed to break or fail when a sufficient load is applied thereto. For instance, once the deflector 316 is anchored in place, an axial load may be placed on, or applied to, the barrel 324 of the coring assembly 306 (e.g., by applying a downwardly directed force to a drill string coupled to the barrel 324). The anchored deflector 316 may be configured to have higher resistance to the axial load as compared to the sacrificial element 342, and the sacrificial element 342 may therefore break or sever before the deflector 316 moves or becomes unanchored.

In another implementation, the coring assembly 306 may rotate to break the sacrificial element 342. By way of illustration, the coring bit 318, stabilizer 320, and/or barrel 324 of the coring assembly 306 may be configured to rotate and drill a lateral borehole section in a sidewall of the wellbore 302. When a sufficient rotational force is applied to the barrel 324 (e.g., by using a drill string after anchoring of the deflector 316), the sacrificial element 342 may break or fail. Once the sacrificial element 342 breaks, the coring assembly 306 may be allowed to move relative to the deflector 316. The coring assembly 306 could then, for instance, be used to obtain a core sample from the lateral borehole while the deflector 316 remains anchored in place to direct the coring bit 318 into the lateral borehole.

The sacrificial element 342 may take any number of different forms. In FIG. 8, the sacrificial element 342 may be a shear screw/pin or break bolt configured to fail when a load is applied to translate or rotate the coring assembly 306 relative to a deflector 316 anchored within the wellbore 302. In other implementations, the sacrificial element 342 may include a notched tab, or other type of sacrificial element. In still other implementations, the sacrificial element 342 can be replaced by any other suitable non-sacrificial coupler allowing selective disengagement of the coring assembly 306 relative to the deflector 316.

FIG. 8 illustrates a collar 317 of the deflector assembly 308 which may enclose or abut at least a portion of the stabilizer 320. In particular, the example collar 317 may include an interior surface having a diameter less than a diameter of some portion of the stabilizer 320 (or coring bit 318 or portion of the barrel 324). In this particular example, the collar 317 includes an interior bearing sleeve 344. As shown in FIG. 8, the stabilizer 320 may be sized so that when drawn against the collar 317, the stabilizer 320 engages the distal end portion of the bearing sleeve 344. The bearing sleeve 344 may restrict upwardly directed movement of the stabilizer 320 relative to the collar 317. The bearing sleeve 344 may also provide other functions in addition to limiting upward movement of the coring assembly 306. For instance, the bearing sleeve 344 may include a bearing or bushing surface that facilitates rotation of the barrel 324 within the bearing sleeve 344. In some implementations, rotation of the barrel 324 within the bearing sleeve 344 may occur following decoupling of the coring assembly 306 from the deflector assembly 308.

Figure 10:
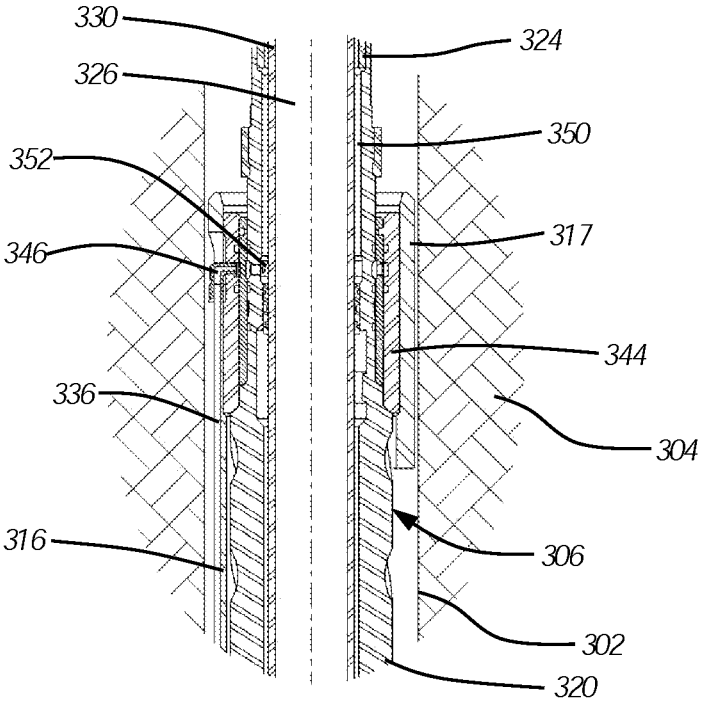
FIG. 10 is an enlarged view of a portion of the implementation illustrated in FIG. 9.
Figure 9:
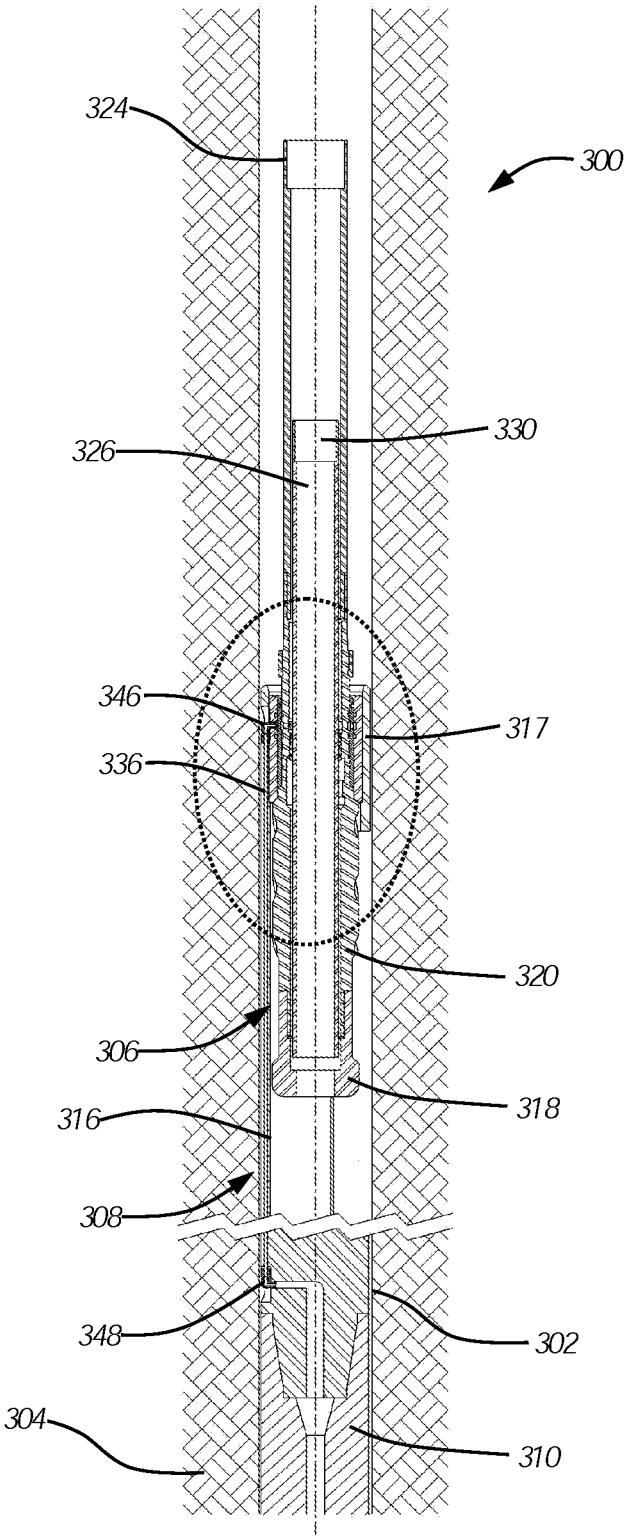
FIG. 9 is another partial cross-sectional view of the coring system of FIG. 6, and includes a view of a coring assembly and whipstock coupled by a hydraulic actuation system for anchoring the whipstock within a wellbore, in accordance with one or more implementations of the present disclosure.

As described previously, the sacrificial element 342 may be sacrificed by severing, or another type of coupler may be selectively released, after the deflector 316 is anchored in place. The deflector 316 can be anchored in any suitable manner, such as by using mechanical, electro-mechanical, hydraulic, pneumatic, or other mechanisms, or some combination of the foregoing. FIGS. 9 and 10 illustrate one example manner of a suitable system that may be used by the coring assembly 306 and deflector assembly 308 to anchor the deflector assembly 308 in place.

In particular, FIGS. 9 and 10 illustrate an example cross-sectional view of the coring system 300 in which a hydraulic line 336 may extend from the coring assembly 306 to the deflector assembly 308. Hydraulic fluid may flow through the barrel 324 (e.g., via channel 350), through port 352 and out a hydraulic outlet 346 that is in fluid communication with the interior or bore of barrel 324 and/or the stabilizer 320. Fluid may then flow through the hydraulic line 336 and into the deflector 316 or an anchor assembly 310 through a hydraulic inlet 348. Thus, a hydraulic fluid pathway may include barrel 324 (i.e., channel 350), port 352, hydraulic outlet 346, hydraulic line 336, and hydraulic inlet 348. The hydraulic inlet 348 is shown in FIG. 9 as being located in the deflector 316 and in fluid communication with a bore in the anchor 310; however, in other embodiments the hydraulic inlet 348 may be formed directly in the anchor 310. The anchor assembly 310 is illustrated only in FIG. 9; however, those skilled in the art will readily recognize that the anchor assembly 310 may be coupled to the bottom end portion of the deflector 316 in FIGS. 6, 7, 11, and 13 which illustrate this implementation. Hydraulic pressure resulting from the flow of the hydraulic fluid may then expand one or more anchors or otherwise cause an anchor to secure the deflector 316 at a desired position and orientation.

As best shown in FIG. 10, some implementations may further contemplate additional components for routing hydraulic fluid through the barrel 324 to an anchor assembly 310 (see FIG. 9). In particular, FIG. 10 illustrates an inner barrel 330 located inside the barrel 324. The inner barrel 330 may be sized so that a channel 350 may exist in the annular region or annulus between the interior wall or surface of the barrel 324 and the outer wall or surface of the inner barrel 330. The channel 350 may also continue in the annular region between the interior wall or surface of the stabilizer 320 and the outer wall or surface of the inner barrel 330. The hydraulic fluid may flow through the channel 350 and into a port 352. Fluid passing through the port 352 can then pass into the hydraulic outlet 346 and through the hydraulic line 336 as described herein.

Figure 11:
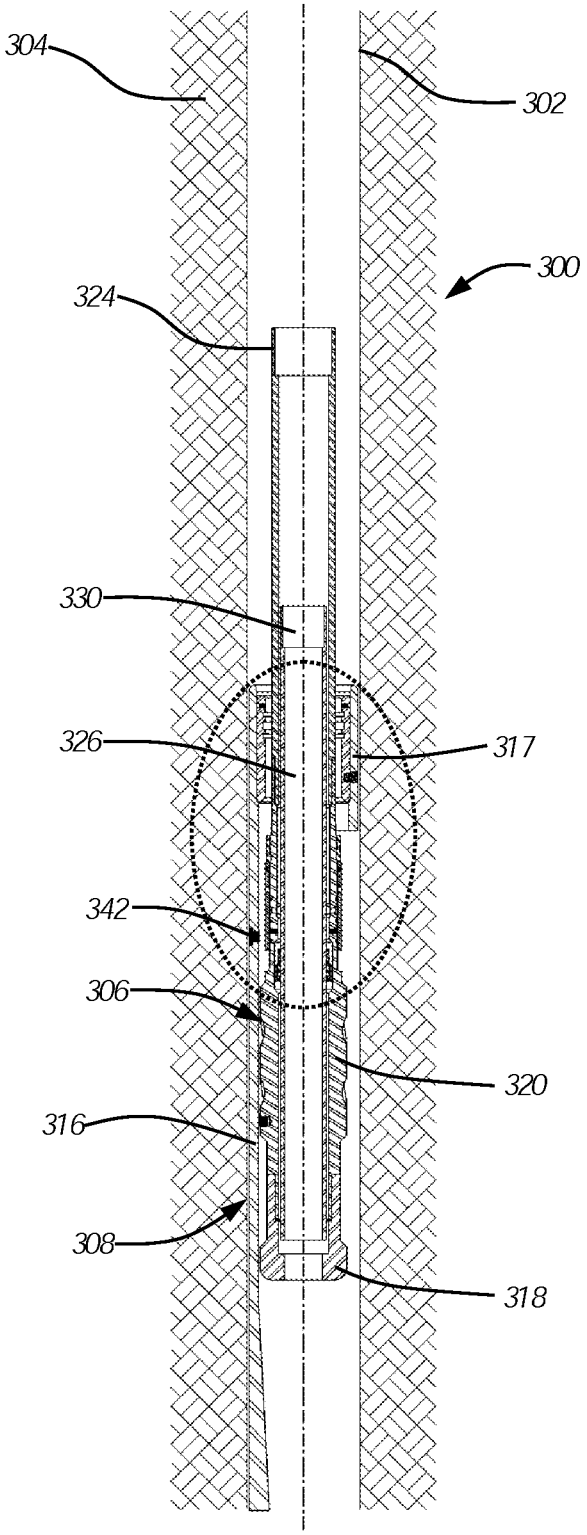
FIG. 11 is a partial cross-sectional view of the coring system of FIG. 6 when the coring assembly has been detached from the whipstock to allow drilling of a lateral borehole, in accordance with one or more implementations of the present disclosure.
Figure 12:
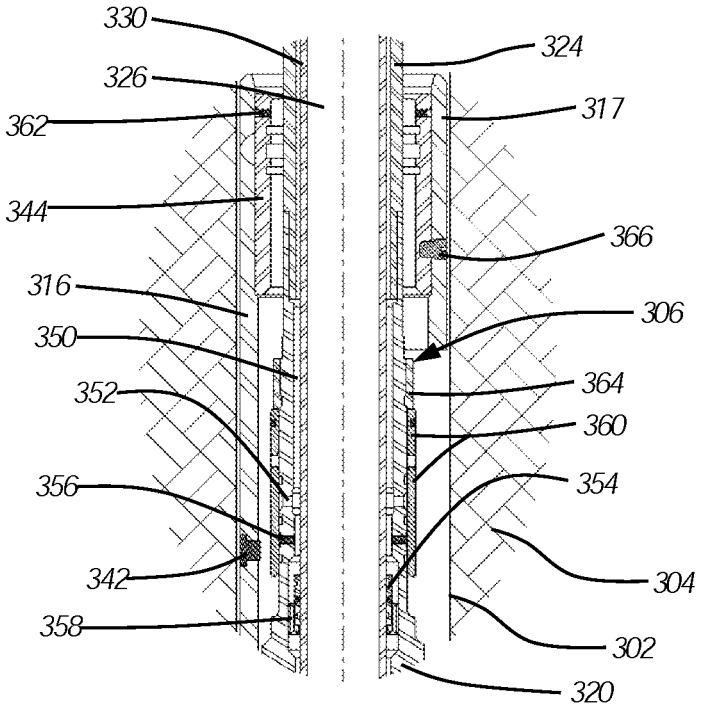
FIG. 12 is an enlarged view of a portion of the implementation illustrated in FIG. 11.

With the anchor assembly 310 set or actuated to secure the deflector 316 in place with the side wall of the borehole 302, the sacrificial element 342 may then be broken and the coring assembly 306 released to extract a core sample while drilling a lateral wellbore. FIGS. 11 and 12 illustrate an implementation in which the sacrificial element 342 has broken or been severed and separate segments are located in the deflector 316 and the stabilizer 320 (severed remaining portion of sacrificial element 342 not shown with respect to stabilizer 320 in FIGS. 11 and 12). Breakage or failure of the sacrificial element 342 allows the coring assembly 306 to move downwardly relative to the deflector assembly 308.

In particular, in this implementation, and compared to the implementation in FIGS. 7 and 8, the stabilizer 320 and coring bit 318 have moved downwardly or downhole from the collar 317. Consequently, the portions of the sacrificial element 342 are no longer in alignment, and the stabilizer 320 may no longer be engaged with the collar 317 or bearing sleeve 344. Such movement may allow the coring assembly 306 to then cut a lateral borehole and extract a core sample as described herein.

As best viewed in FIGS. 8 and 12, various additional components may be included as part of the coring assembly 306 to provide a variety of functions, as described in greater detail hereafter. FIG. 8 illustrates an example in which the coring assembly 306 includes a pressure sleeve 354 between the barrel 324 and the inner barrel 330. In particular, the pressure sleeve 354 may be positioned within the channel 350 and adjacent (or proximate) the port 352. In one or more implementations, the pressure sleeve 354 may block downward flow of the hydraulic fluid so that the hydraulic fluid flows through the port 352 and to the anchor assembly 310 (see FIG. 9).

The pressure sleeve 354 may be secured in place using a coupler 356. In this particular implementation, the coupler 356 may fix the pressure sleeve 354 at a particular location along the length of the barrel 324. In at least some implementations, the coupler 356 may include a shear screw, break bolt, or other sacrificial element that is designed to allow the pressure sleeve 354 to be selectively released from the position illustrated in FIG. 8. By way of example, as the deflector assembly 308 is being anchored, the pressure sleeve 354 may block the channel 350 below the port 352, thereby allowing the hydraulic fluid to flow through the port 352 and to the anchor assembly 310 (see FIG. 9). Once the anchor assembly 310 is set, however, the hydraulic pressure may continue to build upon the pressure sleeve 354. After reaching a pressure threshold that exceeds a capability of the coupler 356, the coupler 356 may shear, break, fail, or otherwise release or become severed, thereby allowing the pressure sleeve 354 to move relative to the barrel 324. As shown in FIG. 12, for instance, the coupler 356 has broken or been severed, thereby allowing the pressure sleeve 354 to move away (e.g., downhole) from port 352.

When the pressure sleeve 354 moves away from the port 352, hydraulic fluid may then flow past or downhole of port 352. As shown in FIG. 12, that portion of the channel 350 disposed downhole of the port 352 may optionally increase in size to allow the hydraulic fluid to flow within the channel 350 and around the pressure sleeve 354. The channel 350 may extend downward through the stabilizer 320 and to the coring bit 318. In such an implementation, the hydraulic fluid may then flow to the opening 319 in the coring bit 318 and act as a cutting fluid for the coring bit 318. In some implementations, one or more vents 358, in fluid communication with the channel 350, may also be provided. The vents 358 may also facilitate flow and circulation of the hydraulic fluid to the coring bit 318. Once the hydraulic fluid begins flowing to the coring bit 318, the coring assembly 306 may be separated from the deflector assembly 308. By placing an axial load on the coring assembly 306 after the deflector 316 is anchored in place, the sacrificial element 342 may shear or otherwise break, as previously described.

Optionally, when the coring assembly 306 is separated from the deflector assembly 308, the flow of the hydraulic fluid to the deflector 316 may cease. As previously described herein, the hydraulic fluid within the channel 350 may flow through the ports 352 to deflector 316 and/or to anchor assembly 310 (see FIG. 9). Again referring to FIG. 8, one or more implementations contemplate that the hydraulic fluid flow may pass through a shear sleeve 360 to reach the hydraulic outlet 346 (see FIG. 10). The shear sleeve 360 may be positioned around an exterior surface of the stabilizer 320, and between the stabilizer 320 and the collar 317. In FIG. 8, the shear sleeve 360 is shown as being positioned between the bearing sleeve 344 of the collar 317 and the stabilizer 320. A fastener or coupler 362 is also shown as coupling the bearing sleeve 344 to the shear sleeve 360. The fastener 362 may be used to align one or more openings in the shear sleeve 360 with the ports 352 so as to allow hydraulic fluid to flow thereto. Once the deflector 316 is anchored in place, however, the hydraulic fluid flow to the deflector 316 may no longer be desired. Indeed, as previously described, the hydraulic fluid flow may even be at least partially allowed to circulate or flow to the coring bit 318. In some implementations, the flow through the ports 352 may also be interrupted, such as by changing an alignment of the ports 352 and the shear sleeve 360.

As best shown in FIG. 12, upon release of the sacrificial element 342, the coring assembly 306 moves relative to the deflector 316 and the stabilizer 320 may move relative to the shear sleeve 360. A stop ring 364 coupled to the stabilizer 320 may engage an upper end portion of the shear sleeve 360. By moving the coring assembly 306 downhole relative to the deflector 316, the stop ring 364 may exert a downward force that causes the fastener 362 to release or shear. In some implementations, the fastener 362 may be a sacrificial element, such as a shear screw/pin or break bolt. Thus, the downwardly acting force on the stabilizer 320 and stop ring 364 may cause the fastener 362 coupled between the bearing sleeve 344 and the shear sleeve 360 to fail or become severed, thereby allowing the shear sleeve 360 to move downwardly relative to the collar 317. As shown in FIG. 12, when the shear sleeve 360 is positioned against or adjacent the stop ring 364, the shear sleeve 360 may cover or at least partially cover the ports 352. As a result, hydraulic fluid within the channel 350 may be blocked from entering the ports 352 and may flow downwardly to the coring bit 318.

Figure 14:
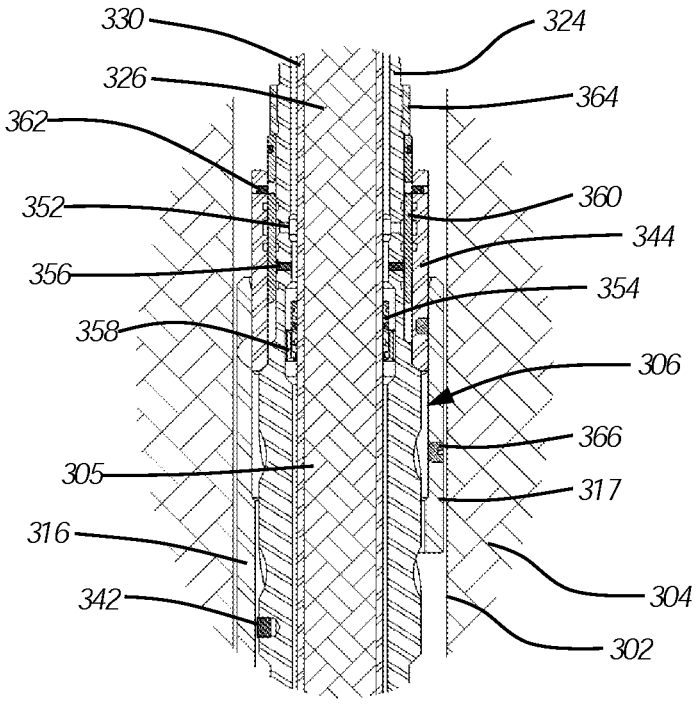
FIG. 14 is an enlarged view of a portion of the implementation illustrated in FIG. 13.
Figure 13:
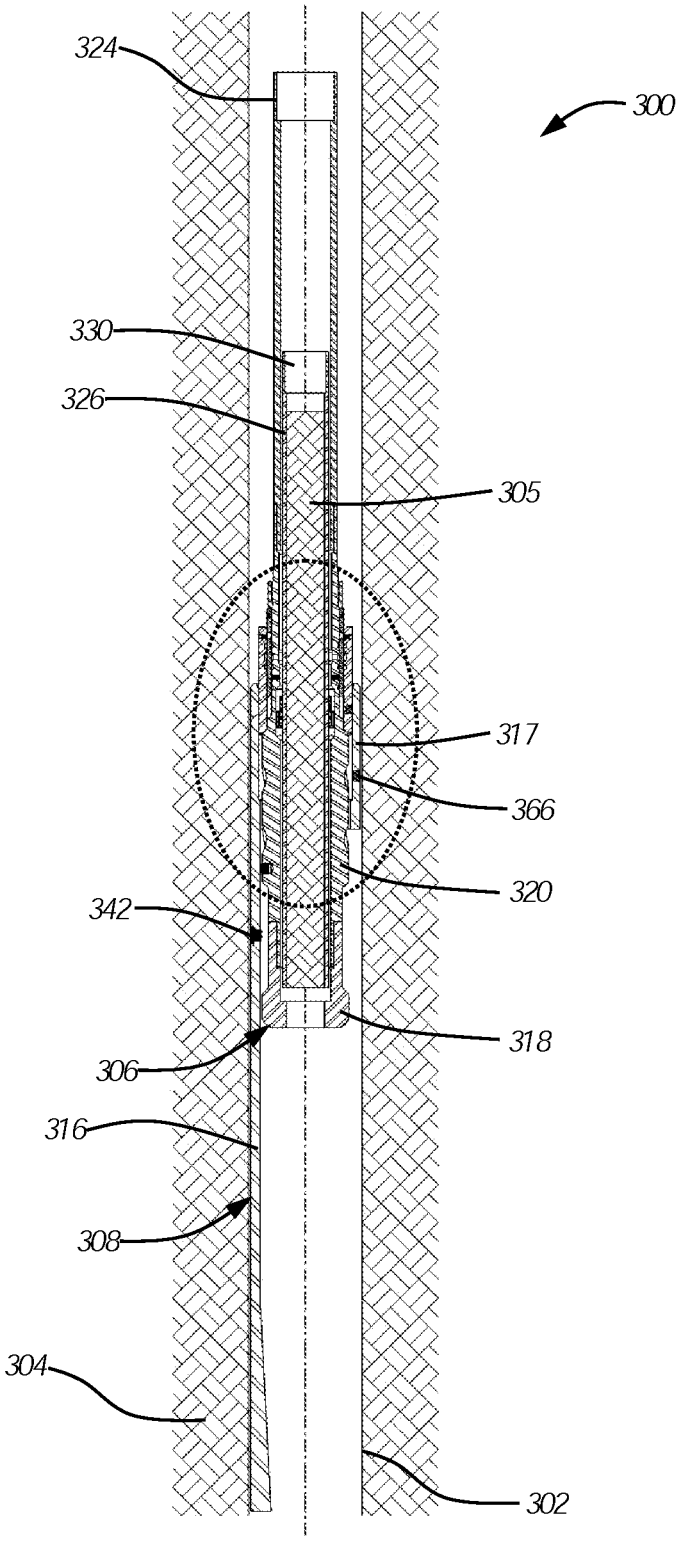
FIG. 13 is a partial cross-sectional view of the coring system of FIG. 6 when extracting a core sample obtained from a lateral borehole, and when the whipstock is unable to be retrieved from within the wellbore, in accordance with one or more implementations of the present disclosure.

When the hydraulic fluid is flowing to the coring bit 318, the coring bit 318 may be used to cut into the formation 304 and extract a core sample 305, as shown in FIGS. 13 and 14. In some implementations, the core sample 305 may be extracted from a lateral borehole. For example, the deflector 316 may include a whipstock that causes the coring bit 318 to form a lateral borehole while also obtaining a core sample therefrom. When a desired core sample 305 is obtained, the drilling of the lateral borehole using the coring bit 318 may be stopped and the coring assembly 306 may be retrieved from the lateral borehole as well as wellbore 302. Retrieval may include pulling upwardly on the coring assembly 306 (e.g., on the barrel 324) to move the coring assembly 306 toward the surface.

As described previously, one or more implementations contemplate retrieving the core sample 305, coring assembly 306, and deflector assembly 308 in a single trip. In accordance with one such implementation, as the coring assembly 306 is moved uphole, the stabilizer 320 (or coring bit 318 or barrel 324) may engage against the collar 317. For instance, as best seen in FIG. 8, the collar 317 may include a bearing sleeve 344 forming a shoulder restricting the stabilizer 320 from moving upwardly past the collar 317. Consequently, as the coring assembly 306 moves upwardly, the coring assembly 306 may engage the deflector assembly 308. The deflector assembly 308 may be or become unanchored and may then be retrieved along with the coring assembly 306. As described in greater detail hereafter, one or more implementations contemplate that an upwardly directed axial force may be used to unanchor the deflector assembly 308.

The deflector assembly 308 may inadvertently become irretrievable from wellbore 302. In one or more implementations, the coring system 300 of FIGS. 6-14 may include a mechanism for retrieving the coring assembly 306 and the coring sample 305 even if the deflector assembly 308 is stuck or otherwise irretrievable. FIG. 8 illustrates an additional sacrificial element 366 coupling the collar 317 to the bearing sleeve 344. If the deflector assembly 308 were to be stuck within the wellbore 302, the sacrificial element 366 may be configured to break or fail, thereby releasing the bearing sleeve 344 from the collar 317. The sacrificial element 366 may thus act as an emergency release coupling, or fail-safe release coupling, that shears to allow the core sample 305 to be extracted. FIGS. 13 and 14 illustrate an implementation in which pulling upwardly on the coring assembly 306 has caused the sacrificial element 366 to fail, thereby allowing the coring assembly 306 and bearing sleeve 344 to be removed from within the collar 317.

While FIGS. 6-14 describe various components in the context of a coring system, it should be appreciated that such an implementation is merely illustrative. One or more of the described implementations may route hydraulic fluid from a coring assembly 306 to a deflector assembly 308 and/or anchor assembly 310, and then re-direct such fluid when a coring operation is to begin. However, such an implementation may be utilized in other contexts. In particular, the use of the channel 350, ports 352, pressure sleeve 354, shear sleeve 360, coupler 356, fastener 362, vents 358, and other components may effectively form a fluid bypass valve to divert hydraulic fluid from one location (e.g., through ports 352) to another (e.g., through vents 358 or further along the channel 350). Accordingly, components of the implementations in FIGS. 6-14 may also be used in other environments in which a bypass valve may be useful for circulating or re-directing fluid.

In general, the coring system 300 of FIGS. 6-14 and the coring systems 100 and 200 of FIGS. 1-5 may include similar or identical components that may be combined in any number of manners. In addition, features may be added or modified as desired. For instance, while some implementations contemplate using a stabilizer, the stabilizer may be omitted in other implementations, or more than one stabilizer may be included. Moreover, various components may be located or coupled at varying locations. For instance, while FIGS. 7-14 illustrate coupling various components to a stabilizer 320 (e.g., the sacrificial element 342, stop ring 364, coupler 356, etc.) other implementations contemplate such components being coupled to a coring bit 318, barrel 324, inner barrel 330, or other component or feature. Thus, the implementations illustrated and described are intended to be illustrative only, and not limiting. Moreover, while various sacrificial elements, couplers, and fasteners are described as being intended to fail, break, or be severed, such implementations are merely illustrative. As described herein, where such components are designed to selectively secure an element of a coring system, a latch, clasp, or other such feature readily known to those skilled in the art may also or alternatively be used.

As should be appreciated by those skilled in the art in view of the disclosure herein, some implementations of the present disclosure may relate to apparatus, systems, and methods for anchoring a deflector and extracting a core sample in a single trip. In accordance with one or more of those implementations, the deflector may also be anchored and thereafter unanchored to allow setting and retrieval in the same, single trip.

Figure 15:
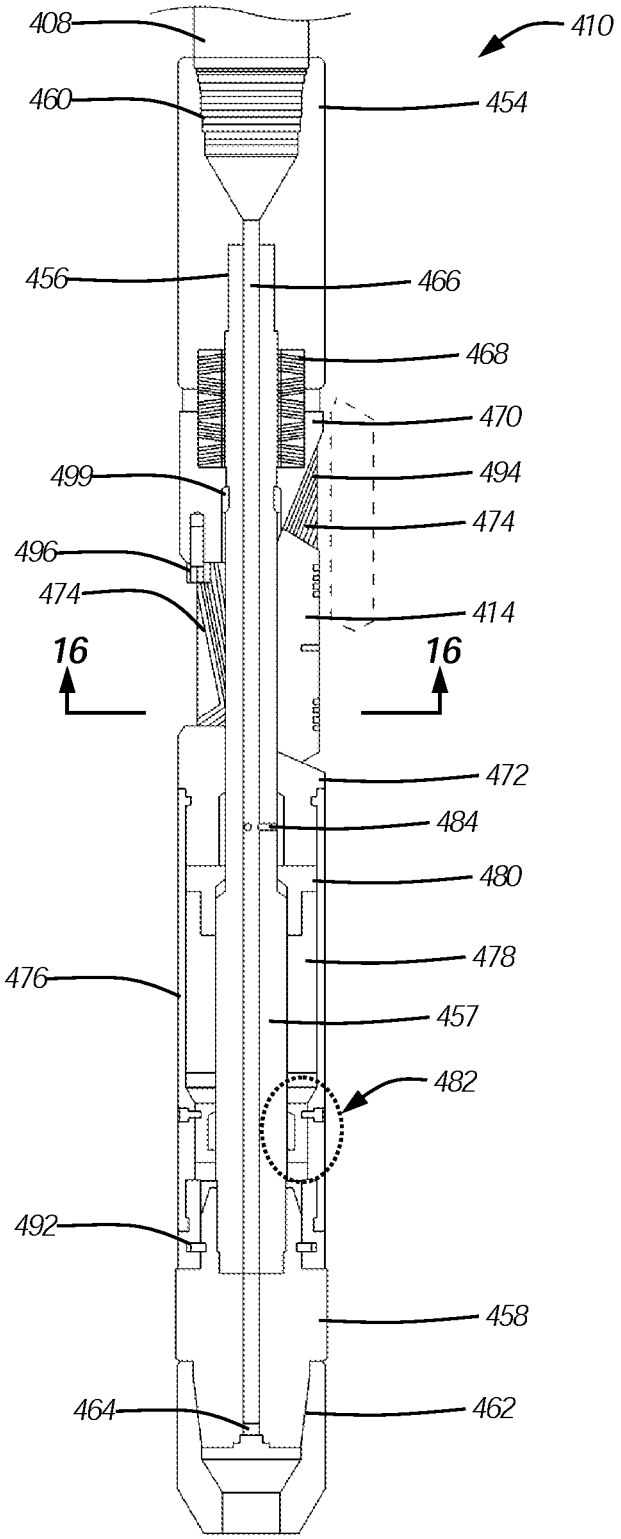
FIG. 15 illustrates a cross-sectional view of an example anchor assembly that may be used in a coring system in accordance with one or more implementations of the present disclosure.
Figure 16:
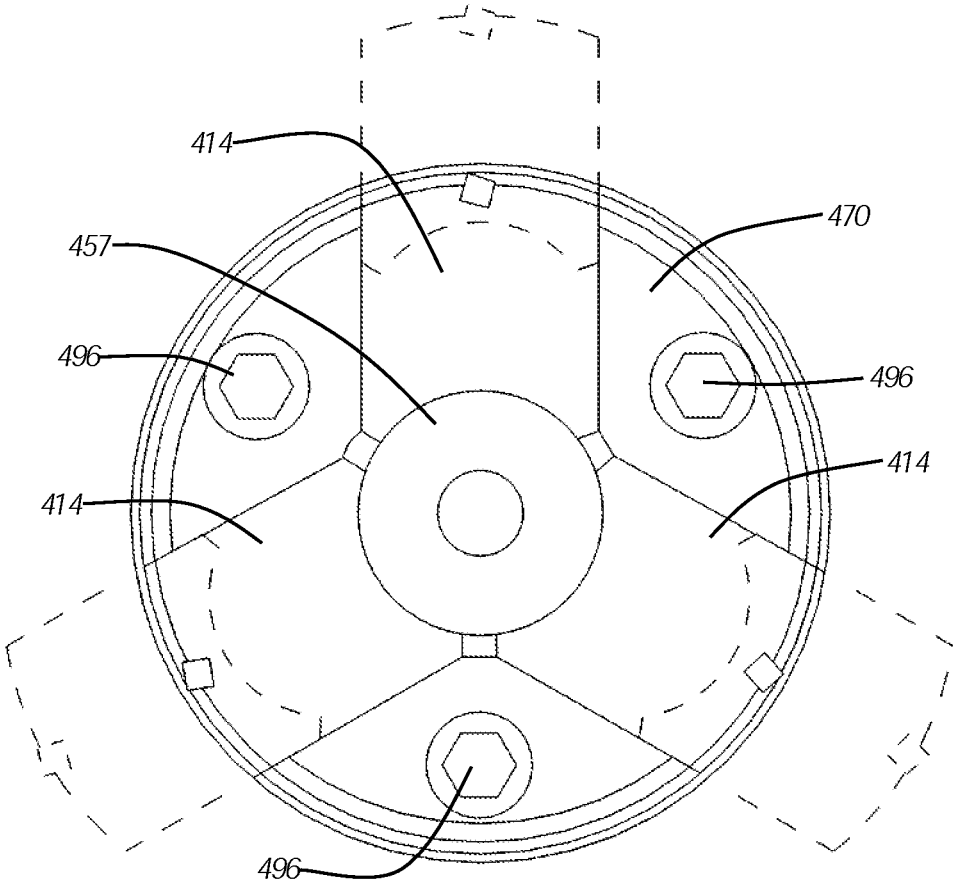
FIG. 16 illustrates a cross-sectional end portion view of the anchor assembly of FIG. 15, taken along the plane 16-16 of FIG. 15.
Figure 17:
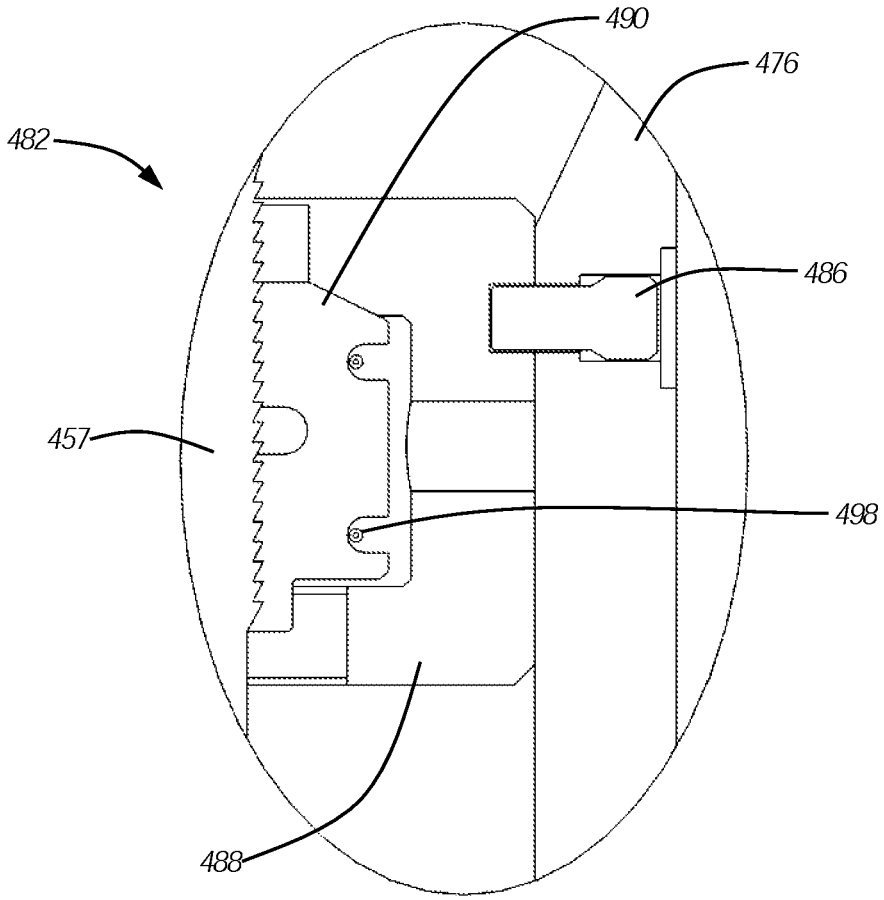
FIG. 17 illustrates an enlarged cross-sectional view of one or more implementations of a locking subassembly of the anchor assembly of FIG. 15.

An example anchor assembly 410 that may be used in connection with implementations of the present disclosure, for example, as anchor assembly 110 or anchor assembly 310, is shown in additional detail in FIGS. 15-17 and is additionally disclosed in U.S. Pat. No. 7,377,328 to Dewey et al. This particular anchor assembly 410 includes an anchor body 412 and one or more expandable slips 414. More particularly, as described in greater detail below, hydraulic fluid passing through the anchor body 412 may be used to selectively expand the expandable slips 414, which may then engage the side wall of a wellbore.

FIGS. 15-17 depict the example implementation of the anchor assembly 410, with various operational positions. In one implementation, the anchor assembly 410 may be used, for example, in combination with a coring assembly and a deflector assembly for extracting a core sample from a lateral borehole. It should be appreciated, however, that the anchor assembly 410 may be used in many different types of assemblies, and downhole assemblies, coring assemblies, and deflector assemblies provide only some of the representative assemblies with which the anchor assembly 410 may be used. For instance, the anchor assembly 410 may be used in any drilling assembly using an anchoring tool, including with a whipstock for a sidetracking process. Further, it is to be fully recognized that the different teachings of the implementations disclosed herein may be employed separately or in any suitable combination to produce desired results.

FIGS. 15-17 provide an operational overview of the anchor assembly 410. In particular, the anchor assembly 410 may be lowered into a cased or uncased wellbore in a locked and collapsed position shown in FIGS. 15 and 16. When the anchor assembly 410 reaches a desired depth, the anchor assembly 410 may be unlocked and expanded to a set position shown in phantom lines in FIGS. 15 and 16, where expandable slips 414 of the anchor assembly 410 may engage a surrounding open wellbore wall, or a casing. The anchor assembly 410 may be configured to expand over a range of diameters, and FIGS. 15 and 16 depict the anchor assembly 410 with the maximum expanded configuration shown in phantom lines. Finally, to remove the anchor assembly 410 from the well, the anchor assembly 410 may be released from the wellbore or casing to return to an unlocked and collapsed position as shown in FIG. 15.

The anchor assembly 410 may generally comprise a top sub 454 coupled via threads 456 to a generally cylindrical mandrel 457 having a fluid channel 466 therethrough, which in turn is coupled via threads 456 to a nose 458. In one implementation, the anchor assembly 410 may include an upper box coupler 460 and a lower pin coupler 462 for coupling the anchor assembly 410 into a downhole assembly. The upper box coupler 460 may be coupled to the lower end portion of a deflector assembly 408, for example. Optionally, a pipe plug 464 may be coupled to the nose 458 to close off a fluid channel 466 of the mandrel 457 so that the anchor assembly 410 may be expanded hydraulically.

The mandrel 457 may be the innermost component within the anchor assembly 410. Disposed around and slidingly engaging the mandrel 457 may be a spring stack 468 in the illustrated implementation, along with an upper slip housing 470, one or more slips or gripping elements 414, and/or lower slip housing 472. One or more recesses 474 may be formed in the slip housings 470, 472 to accommodate the radial movement of the one or more slips 414. The recesses 474 may include angled channels formed into the wall thereof, and these channels may provide a drive mechanism for the slips 414 to move radially outwardly into the expanded positions depicted in phantom lines in FIGS. 15 and 16. In one implementation, the anchor assembly 410 may comprise three slips 414 as best shown in FIG. 16, wherein the three slips 414 may be spaced at 120° intervals circumferentially around the anchor assembly 410, and in the same radial plane. It should be appreciated, however, that any number of slips 414 may be disposed in the same radial plane around the anchor assembly 410. For example, the anchor assembly 410 may comprise four slips 414, each approximately 90° from each other, two slips 414, each approximately 180° from each other, or any number of slips 414. Further, while the slips 414 may be offset at equal angular intervals, other implementations contemplate such offsets being varied. For instance, when three slips 414 are used, the one slip 414 may be spaced about 90° from another slip 414 and about 135° from still another slip 414.

In the implementation shown in FIG. 15, a piston housing 476 may be coupled to the lower slip housing 472 (e.g., using threads). The piston housing 476 may form a fluid chamber 478 around the mandrel 457 within which a piston 480 and a locking subassembly 482 may be disposed. The piston 480 may couple to the mandrel 457 (e.g., using threads), and the mandrel 457 may include ports 484 that enable fluid flow from the flowbore 466 into the fluid chamber 478 to actuate the anchor assembly 410 to the expanded position shown in phantom lines in FIGS. 15 and 16. In one implementation, a seal may be provided between the piston 480 and the mandrel 457, between the piston 480 and the piston housing 476, and/or between the piston housing 476 and the lower slip housing 472.

FIG. 17 depicts an enlarged view of the locking subassembly 482, shown releasably coupled to the piston housing 476 via one or more shear screws 486. The locking subassembly 482 shown in FIG. 17 may include a lock housing 488 mounted about the mandrel 457, and a lock nut 490, which interacts with the mandrel 457 to prevent release of the anchor assembly 410 when pressure is released. The outer radial surface of mandrel 457 may include serrations which cooperate with inverse serrations formed on the inner surface of lock nut 490, as described in more detail below.

Referring now to FIGS. 15 and 16, the anchor assembly 410 is illustrated with the slips 414 in a retracted position which allows the anchor assembly 410 to be inserted into a wellbore. When the slips 414 are expanded to the position illustrated in phantom lines in FIGS. 15 and 16, the slips 414 may be in an expanded position, in which the slips 414 extend radially outwardly into gripping engagement with a surrounding open wellbore wall or casing. The anchor assembly 410 may have two operational positions within a particular wellbore—namely a collapsed position as shown in FIGS. 15 and 16 for tripping the anchor into a wellbore, and an expanded position as shown in phantom lines in FIGS. 15 and 16, for grippingly engaging a wellbore.

To actuate the anchor assembly 410, hydraulic forces may be applied to cause the slips 414 to expand radially outwardly from the locked and collapsed position of FIGS. 15 and 16 to the unlocked and expanded position shown in phantom lines. Specifically, fluid may flow down the fluid channel 466 and through the ports 484 in the mandrel 457 into the chamber 478 surrounded by the piston housing 476. When the anchor assembly 410 is the lowermost tool in a drilling, coring, or other system, the pipe plug 464 may be used to close off the fluid channel 466 through the mandrel 457 to allow fluid pressure to build up within the anchor assembly 410 to actuate it (e.g., by radially expanding the slips 414 of the anchor assembly 410). If, however, another tool is run below the anchor assembly 410, the pipe plug 464 may be removed so that hydraulic fluid can flow through the anchor assembly 410 to the lower tool. In such an operation, the lower tool could include a similar pipe plug so that hydraulic pressure can be built up in both the lower tool and the anchor assembly 410 to actuate both tools.

Pressure may continue to build in the fluid chamber 478 as the piston 480 provides a seal therein until the pressure is sufficient to cause shear screws 492 to shear. Since the piston 480 may be coupled to the mandrel 457, the piston 480 may remain stationary while the outer piston housing 476 and the lower slip housing 472 coupled thereto may move axially upwardly from the position shown in FIG. 15. Upward movement of the lower slip housing 472 can act against the slips 414 to drive the slips 414 radially outwardly along the channels 494. This upward motion may also cause the slips 414 and the upper slip housing 470 to move axially upwardly against the force of the spring stack 468, which is optionally a Belleville spring stack.

Because the outer piston housing 476 may be moveable to expand the slips 414 rather than the piston 480, the anchor assembly 410 design may eliminate a redundant piston stroke found in other expandable tools, and the anchor assembly 410 optionally maintains approximately the same axial length in the collapsed position of FIG. 15 and in the expanded position. The anchor assembly 410 may also have a shorter mandrel 457 as compared to other anchors, and the slips 414 may be nearly unidirectional. Therefore, the spring stack 468 can act as a means to store up energy. If the spring stack 468 were not present, the energy stored in the anchor assembly 410 could be based on how much the mandrel 457 stretches as the slips 414 are set against a wellbore. Although the mandrel 457 may be made of a hard metal, such as steel, it may still stretch a small amount, acting as a very stiff spring. Therefore, in order to store up energy in the anchor assembly 410, this spring effect may be weakened or unstiffened to some degree, such as by adding the spring stack 468. In so doing, the stroke length required to set the slips 414 may be increased.

The anchor assembly 410 may also be configured for operation within wellbores having a range of diameters. In an implementation, a spacer screw 496 may be provided to maintain a space between the lower slip housing 472 and the upper slip housing 470 when the anchor assembly 410 is in its maximum expanded position. During assembly of the anchor assembly 410, when installing the slips 414, the upper slip housing 470 and the lower slip housing 472 may be abutted against each other, and extensions in the slips 414 may be aligned with the channels 494 in the recesses 474 of the slip housings 470, 472. Then the upper and lower slip housings 470, 472 may be pulled apart and the slips 414 can collapse into the anchor assembly 410 around the mandrel 457. To guard against the anchor assembly 410 overstroking downhole, the spacer screw 496 can restrict the upper and lower slip housing 470, 472 from abutting together as during assembly, thereby restricting the slips 414 from falling out of the anchor assembly 410. Thus, in the maximum expanded position, the spacer screw 496 may provide a stop surface against which the lower slip housing 472 may be restricted, and potentially prevented, from further upward movement so that it remains spaced apart from the upper slip housing 470. The spacer screw 496 can be provided as a safety mechanism because the slips 414 should engage the wellbore wall in an intermediate expanded position, well before the lower slip housing 472 engages the spacer screw 496.

Thus, the anchor assembly 410 may be fully operational over a wide range of diameters, and can have an expanded position that varies depending on the diameter of the wellbore. As such, the anchor assembly 410 may be specifically designed to provide proper anchoring of a coring, drilling, or other assembly to withstand compression, tension, and torque for a range of wellbore diameters. Specifically, the anchor assembly 410 may be configured to expand up to at least 1.5 times the collapsed diameter of the anchor assembly 410. For example, in one implementation, the anchor assembly 410 may have a collapsed diameter of approximately 8.2 inches (208 mm) and may be designed to expand into engagement with an 8½ inch (216 mm) diameter wellbore up to a 12¼ inch (311 mm) diameter wellbore. Where the anchor assembly 410 is used in a cased wellbore, an anchor assembly 410 having a diameter of approximately 8.2 inches (208 mm) may correspond generally to a 9⅝ inch (244 mm) casing up to 13⅜ inch (340 mm) casing.

Once the slips 414 are expanded into gripping engagement with a wellbore, to prevent the anchor assembly 410 from returning to a collapsed position until so desired, the anchor assembly 410 may include a locking subassembly 482. As the piston housing 476 moves, so too may a lock housing 488 that is coupled thereto via shear screws 486 mounted about the mandrel 457. As shown in FIG. 17, the lock housing 488 may cooperate with a lock nut 490, which can interact with the mandrel 457 to restrict or prevent release of the anchor assembly 410 when hydraulic fluid pressure is released. Specifically, the outer radial surface of mandrel 457 may include one or more serrations which cooperate with inverse serrations formed on the inner surface of the lock nut 490. Thus, as the piston housing 476 moves the lock housing 488 upwardly, the lock nut 490 can also move upwardly in conjunction therewith, causing the serrations of the lock nut 490 to move over the serrations of the mandrel 457. The serrations on the mandrel 457 may be one-way serrations that only allow the lock nut 490 and the components that are coupled thereto to move upstream when hydraulic pressure is applied to the anchor assembly 410. Therefore, because of the ramped shape of the serrations, the lock nut 490 may only be permitted to move in one direction, namely upstream, with respect to the mandrel 457. The interacting serrations can restrict or prevent movement in the downstream direction since there may be no ramp on the mandrel serrations that angle in that direction. Thus, interacting edges of the serrations can ensure that movement will only be in one direction, thereby restricting the anchor assembly 410 from returning to a collapsed position until so desired.

In an implementation, the lock nut 490 may be machined as a hoop and then split into multiple segments. A spring 498 (e.g., a garter spring) may be provided to hold the segments of the lock nut 490 around the mandrel 457. The spring 498 may resemble an O-ring, except that the spring 498 can be made out of wire. Such wire may be looped around the lock nut 490, and the end portions can be hooked together. The spring 498 may allow the sections of the lock nut 490 to open and close as the lock nut 490 jumps over each individual serration as it moves upwardly on the mandrel 457. Thus, the spring 498 may allow the lock nut 490 to slide up the ramp of a mandrel serration and jump over to the next serration, thereby ratcheting itself up the mandrel 457. The spring 498 can also hold the lock nut 490 segments together so that the lock nut 490 cannot back up over the serrations on the mandrel 457.

The anchor assembly 410 may also designed to return from an expanded position to a released, collapsed position. For instance, as discussed herein with respect to the coring systems 100, 200, and 300, some implementations of a coring system contemplate a system in which an anchor may be set (e.g., expanded), a core sample extracted, the anchor released (e.g., un-expanded), and a coring assembly and anchor retrieved, all in a single trip. The anchor assembly 410 may therefore be used in such implementations to allow the anchor to be released, which may allow another component, such as a deflector assembly, to be released and retrieved.

The anchor assembly 410 of FIGS. 15-17 can be released from gripping engagement with a surrounding wellbore by applying an upwardly directed force sufficient to allow the slips 414 to retract to the released and collapsed position shown in FIG. 15. In particular, the lock housing 488 shown in FIG. 17 may be coupled to the piston housing 476 by shear screws 486. To return the anchor assembly 410 to a collapsed position, an axial force can be applied to the anchor assembly 410 sufficient to shear the shear screws 486, thereby releasing the locking subassembly 482. As shown in FIG. 15, a release ring 499 may be disposed between the upper slip housing 470 and the mandrel 457. In one aspect, the release ring 499 can provide a shoulder to restrict the upper slip housing 470 from sliding too far downwardly with respect to the slips 414 in the run-in, retracted position of FIGS. 15 and 16, or after releasing the anchor assembly 410 to the position shown in FIG. 15. In another aspect the release ring 499 may be configured to allow the mandrel 457 to move a small distance axially before the slips 414 disengage from the wellbore to allow for the shear screws 486 to shear completely. Thus, when an axial force is applied to the mandrel 457, the release ring 499 can allow for the slips 414 to maintain engagement with the wellbore to provide a counter force against which the shear screws 486 can shear. Therefore, the release ring 499 can allow the shear screws 486 to shear completely, which enables the slips 414 to collapse back into the anchor assembly 410. With the anchor assembly 410 in the released and collapsed position of FIG. 15, the anchor assembly 410 can be removed from the wellbore.

In accordance with one implementation, the anchor assembly 410 of FIGS. 15-17 may be used in connection with a coring system 100 of FIGS. 1 and 2, a coring system 200 of FIGS. 3-5, or a coring system 300 of FIGS. 6-14. It should be appreciated in view of the disclosure herein, that when coupled to the anchor assembly 410, a coring system 100, 200, or 300 may be used to expand and engage the slips 414 against a formation surrounding a wellbore and anchor a corresponding deflector assembly 108, 208, or 308 in place. In some implementations, optional hydraulic lines or hydraulic fluid pathways (see FIGS. 1, 2, 9 and 10) may be used to provide hydraulic fluid to expand the slips 414.

When a core sample has been obtained, the anchor assembly 410 may be released by applying an upwardly directed force to retract the slips 414 as discussed herein. For instance, as shown in FIGS. 1-14, a collar of a deflector assembly may engage a stabilizer, coring bit, barrel, or other component of a coring assembly. By pulling upwardly on the coring assembly, a corresponding upward force can be transferred to the deflector assembly, which may also be coupled to the mandrel 447 of the anchor assembly 410. Such upward force, if sufficient to shear the shear screws 486, may allow the slips 414 to retract, thereby allowing the coring assembly, deflector assembly, and anchor assembly 410 to be removed. In some implementations, such as where an emergency release coupling is provided (see FIGS. 13 and 14), the upward force sufficient to unanchor the anchor assembly 410 may be less than the force needed to shear the emergency release coupling. In still other implementations, the slips 414 may be released by reducing the hydraulic pressure.

While a hydraulically set anchor assembly has been described above in great detail, those skilled in the art will readily recognize that a mechanically set anchor may alternatively be employed. Explosive charges and the like may also be used to remotely set an anchor assembly and secure a deflector assembly in the desired annular orientation and downhole axial position. Furthermore, packers and the like may be used in place of an anchor assembly or in addition thereto to both anchor the deflector assembly and optionally seal the wellbore therebelow.

Accordingly, the various implementations disclosed herein include components and structures that are interchangeable, and may be combined to obtain any number of aspects of the present disclosure. For instance, in a single trip, a deflector may be anchored in place, a core sample extracted, the deflector released, and the deflector and coring assembly removed. In the same or other implementations, the coring system may potentially be used at multiple locations along a wellbore. For instance, the deflector and coring assembly may be lowered to a desired location and anchored in place. The coring assembly may then be used to extract a core sample, and the deflector can be released. The coring assembly and deflector may then be raised or lowered to another location, where the process may be repeated by anchoring the deflector, extracting a core sample, and potentially releasing the anchored deflector. Such a process may be repeated multiple times to obtain core samples at multiple locations, all in a single trip.

To facilitate obtaining core samples at multiple locations in a single trip, the anchor assembly 410 may be modified in a number of different manners. For instance, a motor, power source, and wireless transponder may be provided. The motor may mechanically move the slips 414 and/or the mandrel 457 to allow selective expansion and retraction of the slips 414. Thus, the shear screws 486 or other sacrificial elements of a coring system may be eliminated and multiple engagements may occur along a length of a wellbore.

Although only a few example implementations have been described in detail above, those skilled in the art will readily appreciate that many modifications are possible in the example implementation without materially departing from the disclosure of "Coring Bit to Whipstock Systems and Methods." Accordingly, all such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific implementations that may fall within the scope of the disclosure and the appended claims. Any described features from the various implementations disclosed may be employed in combination. In addition, other implementations of the present disclosure may also be devised which lie within the scopes of the disclosure and the appended claims. All additions, deletions and modifications to the implementations that fall within the meaning and scopes of the claims are to be embraced by the claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Certain implementations and features may have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges may appear in one or more claims below. All numerical values are "about" or "approximately" the indicated value, and take into account experimental error and variations that would be expected by a person having ordinary skill in the art.

What is claimed is:

1. A single-trip coring system, comprising:

a coring assembly having a barrel with a bore at least partially therethrough for capturing a core sample, the coring assembly also having a coring bit coupled to an end portion of the barrel;

a deflector assembly arranged and designed to deflect the coring bit of the coring assembly into a side wall of a wellbore to drill a lateral section therein, the deflector assembly including a deflector, a collar coupled to the deflector, and a sleeve within the collar and selectively coupled to the collar, the collar restricting upward movement of the coring assembly relative to the deflector assembly and the sleeve within the collar, upon being decoupled from the collar, permitting upward movement of the coring assembly relative to the deflector assembly; and a coupler releasably coupling the coring assembly to the deflector assembly.

2. The single-trip coring system recited in claim 1, wherein the coring assembly further has a stabilizer coupled to the barrel.

3. The single-trip coring system recited in claim 2, wherein the coupler couples the stabilizer to the deflector assembly.

4. The single-trip coring system recited in claim 1, further comprising:

an anchor assembly coupled to the deflector assembly, the anchor assembly having one or more gripping elements for engaging a formation around a wellbore.

5. The single-trip coring system recited in claim 1, further comprising:

a hydraulic fluid pathway extending between the coring assembly and the deflector assembly.

6. The single-trip coring system recited in claim 5, wherein the hydraulic fluid pathway is arranged and designed to selectively permit fluid communication therethrough.

7. The single-trip coring system recited in claim 6, wherein the sleeve is a bearing sleeve and the coring assembly further has a shear sleeve releasably coupled to the collar, the shear sleeve having at least two positions including:

a secured position at which the shear sleeve permits hydraulic fluid flow through the hydraulic fluid pathway; and a released position at which the shear sleeve restricts hydraulic fluid flow through the hydraulic fluid pathway.

8. The single-trip coring system recited in claim 7, wherein a fastener releasably couples the shear sleeve to the collar, the fastener including a sacrificial element arranged and designed to be severed thereby uncoupling the shear sleeve and the collar.

9. The single-trip coring system recited in claim 5, the sleeve being a bearing sleeve and the coring assembly further having a selectively moveable sleeve disposed at least partially within the hydraulic fluid pathway and responsive to pressure to redirect hydraulic fluid flow through the hydraulic fluid pathway.

10. The single-trip coring system recited in claim 9, wherein the selectively moveable sleeve is selectively moveable between at least two positions in response to a change in pressure in the hydraulic fluid pathway, the at least two positions including:

a secured position at which the selectively moveable sleeve blocks hydraulic fluid flow to a portion of the hydraulic fluid pathway; and a released position at which the selectively moveable sleeve permits hydraulic fluid flow around the selectively moveable sleeve to the portion of the hydraulic fluid pathway.

11. The single-trip coring system recited in claim 9, wherein a coupler releasably couples the selectively moveable sleeve to the barrel, the coupler including a sacrificial element arranged and designed to be severed thereby uncoupling the selectively moveable sleeve and the barrel.

12. The single-trip coring system recited in claim 1, further comprising an emergency release coupling between the collar and the sleeve within the collar.

13. The single-trip coring system recited in claim 12, wherein the emergency release coupling is configured to decouple the coring assembly and sleeve from the collar in response to upward force on the coring assembly to allow the coring assembly to be moved uphole of the deflector assembly.

14. The single-trip coring system recited in claim 12, wherein the sleeve is a bearing sleeve and has a bore therethrough, the bore adapted to receive the coring assembly therethrough, and wherein the emergency release coupling includes a sacrificial element coupling the bearing sleeve to the collar.

15. The single-trip coring system recited in claim 1, further comprising:

an anchoring assembly coupled to the deflector.

16. A method for extracting a core sample from a lateral section drilled into a side wall of a wellbore, and within a single trip, the method comprising:

lowering a coring system into a wellbore, the coring system including a coring assembly releasably coupled to a deflector assembly;

anchoring the deflector assembly at a desired angular orientation and axial position within the wellbore;

releasing a coupler between the coring assembly and the deflector assembly;

drilling a lateral section into a sidewall of the wellbore with the coring assembly guided by the deflector assembly;

obtaining a core sample from the lateral section drilled into the sidewall of the wellbore;

retracting the coring assembly from the lateral section and engaging the coring assembly against the deflector assembly;

unanchoring the deflector assembly from the desired angular orientation and axial position within the wellbore; and removing the deflector assembly, the coring assembly and the core sample from the wellbore, the method being accomplished in a single trip.

17. The method recited in claim 16, wherein releasing the coupler between the coring assembly and the deflector assembly includes shearing a sacrificial element.

18. The method recited in claim 16, wherein anchoring the deflector assembly includes routing hydraulic fluid through the coring assembly to the deflector assembly.

19. A coring system, the coring system comprising:

an outer barrel;

an inner barrel disposed within the outer barrel, an annular region between the outer barrel and inner barrel defining a channel for conveying fluid;

a port in fluid communication with the channel and leading to a fluid outlet;

a pressure sleeve disposed between the outer barrel and the inner barrel, the pressure sleeve responsive to pressure within the channel;

a first coupler coupled to the pressure sleeve, the first coupler arranged and designed to be uncoupled to allow the pressure sleeve to selectively move between a first position blocking fluid flow through the channel while permitting fluid flow through the port and a second position permitting fluid flow through the channel around the pressure sleeve;

a shear sleeve disposed around the outer barrel; and a second coupler coupled to the shear sleeve, the second coupler arranged and designed to be uncoupled to allow the shear sleeve to selectively move between a first position permitting fluid flow through the port to the fluid outlet and a second position blocking fluid flow from the port to the fluid outlet.

20. The coring system recited in claim 19, wherein at least one of the first or second couplers includes a sacrificial element arranged and designed to be severed by an application of force thereto.

* * * * *